US007634092B2

(12) United States Patent
McGrath

(10) Patent No.: US 7,634,092 B2
(45) **Date of Patent: *Dec. 15, 2009**

(54) HEAD RELATED TRANSFER FUNCTIONS FOR PANNED STEREO AUDIO CONTENT

(75) Inventor: David S. McGrath, Rose Bay (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1007 days.

This patent is subject to a terminal disclaimer.

(21) Appl. No.: 10/965,130

(22) Filed: Oct. 14, 2004

(65) Prior Publication Data

US 2006/0083394 A1 Apr. 20, 2006

(51) Int. Cl.
*H04R 5/00* (2006.01)
*H04R 1/10* (2006.01)
*H04R 5/02* (2006.01)

(52) U.S. Cl. ..... 381/17; 381/1; 381/18; 381/19; 381/309; 381/310; 381/74

(58) Field of Classification Search ..... 381/1, 381/17–19, 309, 310, 74
See application file for complete search history.

(56) References Cited

U.S. PATENT DOCUMENTS

| | | | | |
|---|---|---|---|---|
| 3,088,997 | A | 5/1963 | Bauer | 179/1 |
| 3,236,949 | A | 2/1966 | Atal et al. | 179/1 |
| 4,893,342 | A | 1/1990 | Cooper et al. | 381/26 |
| 4,910,779 | A | 3/1990 | Cooper et al. | 318/26 |
| 5,333,200 | A | 7/1994 | Cooper et al. | 381/1 |
| 5,440,639 | A | 8/1995 | Suzuki et al. | 381/17 |

(Continued)

FOREIGN PATENT DOCUMENTS

| | | |
|---|---|---|
| WO | WO97/25834 | 7/1997 |

(Continued)

OTHER PUBLICATIONS

A. Mouchtaris, P. Reveliotis and C. Kyriakakis. "Inverse Filter Design for Immersive Audio Rendering Over Loudspeakers." *IEEE Transactions On Multimedia*, vol. 2, No. 2, Jun. 2000.

(Continued)

*Primary Examiner*—Devona E Faulk
(74) *Attorney, Agent, or Firm*—Dov Rosenfeld; Inventek

(57) ABSTRACT

A method to process audio signals, an apparatus accepting audio signals, a carrier medium that carried instructions for a processor to implement the method to process audio signals, and a carrier medium carrying filter data to implement a filter of audio signals. The method includes filtering a pair of audio input signals by a process that produces a pair of output signals corresponding to the results of: filtering each of the input signals with a HRTF filter pair, and adding the HRTF filtered signals. The HRTF filter pair is such that a listener listening to the pair of output signals through headphones experiences sounds from a pair of desired virtual speaker locations. Furthermore, the filtering is such that, in the case that the pair of audio input signals includes a panned signal component, the listener listening to the pair of output signals through headphones is provided with the sensation that the panned signal component emanates from a virtual sound source at a center location between the virtual speaker locations.

61 Claims, 15 Drawing Sheets

U.S. PATENT DOCUMENTS

| | | | | |
|---|---|---|---|---|
| 6,091,894 | A | 7/2000 | Fujita et al. | 703/13 |
| 6,421,446 | B1 | 7/2002 | Cashion et al. | 381/17 |
| 6,614,910 | B1 * | 9/2003 | Clemow et al. | 381/1 |
| 6,766,028 | B1 * | 7/2004 | Dickens | 381/310 |
| 7,167,567 | B1 * | 1/2007 | Sibbald et al. | 381/17 |
| 2006/0045274 | A1 * | 3/2006 | Aarts et al. | 381/17 |
| 2008/0056503 | A1 * | 3/2008 | McGrath | 381/17 |

FOREIGN PATENT DOCUMENTS

| | | |
|---|---|---|
| WO | WO98/20707 | 5/1998 |
| WO | WO2004/028205 | 4/2004 |

OTHER PUBLICATIONS

W. G. Gardner. "Transaural 3-D audio." M.I.T. Media Laboratory Perceptual Computing Section Technical Report #342, 1995.

W. G. Gardner. "3D audio and Acoustic Environmental Modeling." Wavearts, 1999, retrieved on Aug. 13, 2008 at http://3dsoundsurge.com/files/2DAudioWhitePaper.pdf.

J Yang et al., "Development of virtual sound imaging system using triple elevated speakers," IEEE Transactions on Consumer Electronics, vol. 50, No. 3, Aug. 2004.

* cited by examiner

HEAD RELATED TRANSFER FUNCTIONS FOR PANNED STEREO AUDIO CONTENT

BACKGROUND

The present invention is related to the field of audio signal processing, and more specifically to processing channels of audio through filters to provide a perception of spatial dimension, including correctly locating a panned signal while listening using a binaural or transaural playback system.

FIG. 1 shows a common binaural playback system that includes processing multiple channels of audio by a plurality of Head Related Transfer Function (HRTF) filters, e.g., FIR filters, so as to provide a listener 20 with the impression that each of the input audio channels is being presented from a particular direction. FIG. 1 shows the processing of a number, denoted N, of audio sources consisting of a first audio channel 11 (Channel 1), a second audio channel (Channel 2), . . . , and an N'th audio channel 12 (Channel N) of information. The binaural playback system is for playback using a pair of headphones 19 worn by the listener 20. Each channel is processed by a pair of HRTF filters, one filter aimed for playback though the left ear 22 of the listener, the other played through the right ear 23 of the listener 20. So a first HRTF pair of filters 13, 14, up to an N'th pair of HRTF filters 15 and 16 are shown. The outputs of each HRTF filter meant for the left ear 22 of the listener 20 are added by an adder 18, and the outputs of each HRTF filter meant for playback through the right ear 23 of the listener 20 are added by an adder 17. The direction of incidence of each channel perceived by the listener 20 is determined by the choice of HRTF filter pair that is applied to that channel. For example, in FIG. 1, Audio Channel 1(11) is processed through a pair of filters 13, 14, so that the listener is presented with audio input via headphones 19 that will give the listener the impression that the sound of Audio Channel 1 (11) is incident to the listener from a particular arrival azimuth angle denoted $\theta_1$, e.g., from a location 21. Similarly, the HRTF filter pair for the second audio channel is designed such that the sound of Audio Channel 2is incident to the listener from a particular arrival azimuth angle denoted $\theta_2$, . . . , and the HRTF filter pair for N'th audio channel is designed such that the sound of Audio Channel N (12) is incident to the listener from a particular arrival azimuth angle denoted $\theta_N$.

For simplicity, FIG. 1 shows only the azimuth angles of arrival, e.g., the angle of arrival of the perceived sound corresponding to Channel 1 from a perceived source 21. In general, HRTF filters may be used to provide the listener 20 with stimulus corresponding to any arrival direction, specified by both an azimuth angle of incidence and an elevation angle of incidence.

By a HRTF filter pair is meant the set of two separate HRTF filters required to process a single channel for the two ears 22, 23 of the listener, one HRTF filter per ear. Therefore, for two channel sound, two HRTF filters pairs are used.

The description herein is provided in detail primarily for a two-input-channel, i.e., stereo input pair system. Extending the aspects described herein to three or more input channels is straightforward, and therefore such extending is regarded as being within the scope of the invention.

FIG. 2 shows a stereo binauralizer system that includes two audio inputs, a left channel input 31 and a right channel input 32. Each of the two audio channel inputs are separately processed, with the left channel input being processed through one HRTF pair 33,34, and the right channel input being processed through a different HRTF pair 35, 36. In a typical situation, the left channel input 31 and the right channel input 32 are meant for symmetric playback, such that the aim of binauralizing using the two HRTF pairs is to give the perception to the listener of hearing the left and right channels from respective left and right angular locations that are symmetrically positioned relative to the medial plane of the listener 20. Referring to FIG. 2, if the HRTF pairs 33, 34, 35, 36 are for symmetrical listening, the left channel is perceived from source 37 at an azimuth angle θ and the right channel is perceived to be from a source 38 at an azimuth angle that is the negative of the azimuth angle of the right perceived source 37, i.e., from an azimuth angle −θ.

Under conditions of such symmetry, some simplifying assumptions are made. The first is that the listener's head and sound perception is symmetric. That means that:

$$\mathrm{HRTF}(\theta,L)=\mathrm{HRTF}(-\theta,R) \tag{1}$$

Further, the HRTF from the left source 37 to the left ear 22 is equal to the HRTF from the right source 38 to the right ear 23. Denote such an HRTF as $\mathrm{HRTF}_{near}$. Similarly, under such symmetrical assumptions, the HRTF from the left source 37 to the right ear 23 is equal to the HRTF from the right source 38 to the left ear 22. Denote such a HRTF as $\mathrm{HRTF}_{far}$.

In binauralizers, the HRTF filters are typically found by measuring the actual HRTF response of a dummy head, or a human listener's head. Relatively sophisticated binaural processing systems make use of extensive libraries of HRTF measurements, corresponding to multiple listeners and/or multiple sound incident azimuth and elevation angles.

It is common, for a binaural system in use today, to simply use the measured θ and −θ HRTF pairs in a binaural processing system such as that of FIG. 2. In other words, making the assumption that measured HRTFs pairs are symmetrical, $$\mathrm{HRTF}_{near}=\mathrm{HRTF}(\theta,L)$$

$$\mathrm{HRTF}_{far}=\mathrm{HRTF}(\theta,R) \tag{2}$$

Even if it is found by measurement that the listener head responses on which the HRTF pair is measured are not symmetric, such that Eq. 1 does not hold, a binauralizer such as that of FIG. 2 can be forced to be symmetrical by using HRTF filter pairs formed by averaging measured HRTFs. That is, for symmetrically listening to left and right that appear to be from sound sources, called "virtual sound sources," also called "virtual speakers" that are at azimuth angles of θ and −θ, the filters for binaural processing are set as:

$$HRTF_{near}=\frac{HRTF(\theta,L)+HRTF(-\theta,R)}{2} \tag{3}$$

$$HRTF_{far}=\frac{HRTF(\theta,R)+HRTF(-\theta,L)}{2},$$

where HRTF(θ,L) and HRTF(θ,R) are the measured HRTF's for to the left and right angle, respectively, for a perceived source at angle θ. Therefore, by the near and far HRTFs are meant the actual measured or assumed HRTFs for the symmetric case, or the average HRTF's for the non-symmetric case.

Broadly (and roughly) speaking, such a binauralizer simulates the way a normal stereo speaker system works, by presenting the left audio input signal though an HRTF pair corresponding to a virtual left speaker, e.g., 37 and the right audio input signal though an HRTF pair corresponding to a virtual right speaker, e.g., 38. This is known to work well for providing the listener with the sensation that sounds, left and right channel inputs, are emanating from left and right virtual speaker locations, respectively.

In sound reproductions, e.g., through actual stereo speakers, it often is also desired to provide the listener with the sensation not only of left and right audio input sources 31 and 32 appearing to be from the speakers correctly placed to the left and right of the listener, but also from one or more sound sources that are between such left and right speaker locations. Suppose that there is a sound component that is elsewhere, e.g., elsewhere in front of the listener. As an example, suppose there is a sound source that is in the center between the assumed locations of left and right input audio channels. It is common, for example, in modern stereo recordings, for an audio signal to be fed with equal albeit attenuated amplitude to the left and right channels, so that when such left and right channel inputs are played back on stereo speakers in front of the listener, the listener is given the impression that the sound source is emanating from a source, called a "phantom speaker" located centrally between the left and right speakers. The term "phantom" is used for such a speaker because there is no actual speaker there. This is often referred to as a "phantom center," and the process of producing the sensation of a sound coming from the center is called "creating the center image."

Similarly, by proportionally feeding different amounts of a signal to the left and right channel inputs, the sensation of a sound emanating from elsewhere between the left and right speaker locations is provided to the listener.

To so create a stereo pair by diving an input between the left and right channel is called "panning;" equally dividing the signal is called "center panning."

It is desired to provide the same sensation, that is, creating the center image, in a binauralizer system for playback though a set of headphones.

Consider, for example, an audio input signal called MonoInput center panned, e.g., split between the two channel inputs. For example, suppose two signals: LeftAudio and RightAudio are created as:

$$LeftAudio = \frac{MonoInput}{2} \tag{4}$$

$$RightAudio = \frac{MonoInput}{2}$$

The results of a so center panned signal for stereo speaker reproduction is meant to be perceived as a signal emanating from the front center.

If the inputs LeftAudio and RightAudio of Eq. 4 are input to the binauralizer of FIG. 2, the left ear 22 and right ear 23 are fed signals, denoted LeftEar and RightEar, respectively, with:

$$\text{LeftEar}=\text{HRTF}_{near} \otimes \text{LeftAudio}+\text{HRTF}_{far} \otimes \text{RightAudio}$$

$$\text{RightEar}=\text{HRTF}_{near} \otimes \text{RightAudio}+\text{HRTF}_{far} \otimes \text{LeftAudio}' \tag{5}$$

where $\otimes$ denotes the filtering operation, e.g., in the case that $HRTF_{near}$ is expressed as an impulse response, and Left Audio as a time domain input, $HRTF_{near} \otimes$ LeftAudio denotes convolution. So, by combining the equations above, $$LeftEar = HRTF_{near} \otimes \frac{MonoInput}{2} + HRTF_{far} \otimes \frac{MonoInput}{2} \tag{6}$$

$$= \frac{HRTF_{near} + HRTF_{far}}{2} \otimes MonoInput$$

$$RightEar = HRTF_{near} \otimes \frac{MonoInput}{2} + HRTF_{far} \otimes \frac{MonoInput}{2}$$

$$= \frac{HRTF_{near} + HRTF_{far}}{2} \otimes MonoInput$$

It is desired that such a splitting of an input would present the sensation of listening at a virtual speaker position of 0°, that is, the left and right ears are presented with a stimulus that corresponds to a 0° HRTF pair. In practice, this does not happen, so that a listener does not perceive the signal MonoInput to be from a virtual speaker centrally located between the virtual left and right speakers 37 and 38. Similarly, unequally splitting a signal between the left and right channel inputs and then binauralizing through a binauralizer such as shown in FIG. 2 fails to correctly create the illusion of the desired virtual location of the source between the virtual left and right speakers.

There thus is a need in the art for a binauralizer and binauralizing system that creates the illusion to a listener of a sound emanating from a location between the left and right virtual speaker locations of a binauralizer system, where by the left and right virtual speaker locations are meant the locations assumed for a left channel input and right channel input.

A signal that is meant to appear to come from the center rear, e.g., by splitting a mono signal into the left rear and right rear channel inputs, typically will not be perceived to come from the center rear when played back on headphones via a binauralizer that uses symmetric rear HRTF filters aimed at placing the rear speakers at symmetric rear virtual speaker locations.

There thus is a need in the art also for a binauralizer and binauralizing system that creates the illusion to a listener of a sound emanating from the rear center location for rear speaker signals, e.g., surround sound signals of a four or five channel system created by center panning a signal between the left and right virtual rear (surround) speakers.

SUMMARY

Described herein in different embodiments and aspects are a method to process audio signals, an apparatus accepting audio signals, a carrier medium that carried instructions for a processor to implement the method to process audio signals, and a carrier medium carrying filter data to implement a filter of audio signals. When the inputs include a panned signal, each of these provide a listener with a sensation that the panned signal component emanates from a virtual sound source at a center location.

One aspect of the invention is method that includes filtering a pair of audio input signals by a process that produces a pair of output signals corresponding to the results of: filtering each of the input signals with a HRTF filter pair, and adding the HRTF filtered signals. The HRTF filter pair is such that a listener listening to the pair of output signals through headphones experiences sounds from a pair of desired virtual speaker locations. Furthermore, the filtering is such that, in the case that the pair of audio input signals includes a panned signal component, the listener listening to the pair of output signals through headphones is provided with the sensation that the panned signal component emanates from a virtual sound source at a center location between the virtual speaker locations.

Another method embodiment includes equalizing a pair of audio input signals by an equalizing filter, and binauralizing the equalized input signals using HRTF pairs to provide a pair of binauralized outputs that provide a listener listening to the binauralized output via headphones the illusion that sounds corresponding to the audio input signals emanate from a first and a second virtual speaker location. The elements of the method are arranged such that the combination of the equalizing and binauralizing is equivalent to binauralizing using equalized HRTF pairs, each equalized HRTF of the equalized HRTF pairs being the corresponding HRTF for the binauralizing of the equalized signals equalized by the equalizing filter. The average of the equalized HRTFs substantially equals a desired HRTF for the listener listening to a sound emanating from a center location between the first and second virtual speaker locations. In the case that the pair of audio input signals includes a panned signal component, the listener listening to the pair of binauralized outputs through the headphones is provided with the sensation that the panned signal component emanates from a virtual sound source at the center location.

Another aspect of the invention is a carrier medium carrying filter data for a set of HRTF filters for processing a pair of audio input signals to provide a listener listening to the processed signals via headphones the illusion that sounds approximately corresponding to the audio input signals emanate from a first and a second virtual speaker location, the HRTF filters designed such that the average of the HRTF filters approximates the HRTF response of the listener listening to a sound from a center location between the first and a second virtual speaker locations.

Another aspect of the invention is a carrier medium carrying filter data for a set of HRTF filters for processing a pair of audio input signals to provide a listener listening to the processed signals via headphones the illusion that sounds corresponding to the audio input signals emanate from a first and a second virtual speaker location, such that a signal component panned between each of the pair of audio input signals provides the listener listening to the processed signals via headphones the illusion that the panned signal component emanated from a center location between the first and a second virtual speaker locations.

Another aspect of the invention is a method that includes accepting a pair of audio input signals for audio reproduction, shuffling the input signals to create a first signal ("sum signal") proportional to the sum of the input signals and a second signal ("difference signal") proportional to the difference of the input signals, and filtering the sum signal through a filter that approximates the sum of an equalized version of a near ear HRTF and an equalized version of a far ear HRTF. The near ear and far ear HRTFs are for a listener listening to a pair of virtual speakers at corresponding virtual speaker locations. The equalized versions are obtained using an equalization filter designed such that the average of the equalized near ear HRTF and equalized far ear HRTF approximates a center HRTF for a listener listening to a virtual sound source at a center location between the virtual speaker locations. The method further includes filtering the difference signal through a filter that approximated the difference between the equalized version of the near ear HRTF and the equalized version of the far ear HRTF for the listener listening to the pair of virtual speakers. The method further includes unshuffling the filtered sum signal and the filtered difference signal to create a first output signal proportional to the sum of the filtered sum and filtered difference signals and a second output signal proportional to the difference of the filtered sum and filtered difference signals. The method is such that in the case that the pair of audio input signals includes a panned signal component, the listener listening to the first and second output signals through headphones is provided with the sensation that the panned signal component emanates from the virtual sound source at the center location.

Another aspect of the invention is a method that includes filtering a pair of audio input signals for audio reproduction, the filtering by a process that produces a pair of output signals corresponding to the results of filtering each of the input signals with a HRTF filter pair, adding the HRTF filtered signals, and cross-talk cancelling the added HRTF filtered signals. The cross-talk cancelling is for a listener listening to the pair of output signals through speakers located at a first set of speaker locations. The HRTF filter pair are such that a listener listening to the pair of output signals experiences sounds from a pair of virtual speakers at desired virtual speaker locations. The filtering is such that, in the case that the pair of audio input signals includes a panned signal component, a listener listening to the pair of output signals through the pair of speakers at the first set of speaker locations is provided with the sensation that the panned signal component emanates from a virtual sound source at a center location between the desired virtual speaker locations.

Another aspect of the invention is a method that includes accepting a pair of audio input signals for audio reproduction, shuffling the input signals to create a first signal ("sum signal") proportional to the sum of the input signals and a second signal ("difference signal") proportional to the difference of the input signals, filtering the sum signal through a filter that approximates twice a center HRTF for a listener listening to a virtual sound source at a center location, filtering the difference signal through a filter that approximates the difference between a near ear HRTF and a far ear HRTF for the listener listening to a pair of virtual speakers, and unshuffling the filtered sum signal and the filtered difference signal to create a first output signal proportional to the sum of the filtered sum and filtered difference signals and a second output signal proportional to the difference of the filtered sum and filtered difference signals. The method is such that in the case that the pair of audio input signals includes a panned signal component, the listener listening to the first and second output signals through headphones is provided with the sensation that the panned signal component emanates from the virtual sound source at the center location.

In one version of the method, the filter that approximates twice the center HRTF is obtained as the sum of equalized versions of the near ear HRTF and the far ear HRTF, respectively, obtained by filtering the near ear HRTF and the far ear HRTF, respectively, by an equalizing filter, and wherein the filter that approximates the difference between the near ear HRTF and the far ear HRTF is a filter that has a response substantially equal to the difference between the equalized versions of the near ear HRTF and the far ear HRTF.

In one version of the method, the equalizing filter is an inverse filter for a filter proportional to the sum of the near ear HRTF and the far ear HRTF. In a particular embodiment, the equalizing filter response is determined by inverting in the frequency domain a filter response proportional to the sum of the near ear HRTF and the far ear HRTF.

In another particular embodiment, the equalizing filter response is determined by an adaptive filter method to invert a filter response proportional to the sum of the near ear HRTF and the far ear HRTF.

In one version of the method, the filter that approximates twice the center HRTF is a filter that has a response substantially equal to twice a desired center HRTF.

In a particular arrangement, the audio input signals include a left input and a right input, the pair of virtual speakers are at a left virtual speaker location and a right virtual speaker location symmetric about the listener, and the listener and listening are symmetric such that near HRTF is the left virtual speaker to left ear HRTF and the right virtual speaker to right ear HRTF, and such that far HRTF is the left virtual speaker to right ear HRTF and the right virtual speaker to left ear HRTF.

In an exemplary embodiment of the method, the audio input signals include a left input and a right input, the pair of virtual speakers are at a left virtual speaker location and a right virtual speaker location, and the near HRTF is proportional to the average of the left virtual speaker to left ear HRTF and the right virtual speaker to right ear HRTF, and wherein the far HRTF is proportional to the average of the left virtual speaker to right ear HRTF and the right virtual speaker to left ear HRTF.

In another exemplary embodiment, the audio input signals include a left input and a right input, and the pair of virtual speakers are at a left front virtual speaker location and a right front virtual speaker location to the front of the listener.

Other aspects and features will be clear from the description, drawings, and claims.

BRIEF DESCRIPTION OF THE DRAWINGS

FIG. 4A shows a 0° HRTF, FIG. 4B shows near ear HRTF, FIG. 4C a far ear HRTF, and FIG. 4D shows the average of the near and far ear HRTFs.

FIG. 5A shows the impulse response of the equalization filter to be applied to the near and far HRTFs. FIGS. 5B and 5C respectively show near ear and far ear HRTFs after equalization, and FIG. 5D shows the resulting average of the equalized near and far ear HRTFs according to aspects of the invention.

DETAILED DESCRIPTION

One aspect of the present invention is a binauralizer and binauralizing method that, for the case of a stereo pair of inputs, uses measured or assumed HRTF pairs for two sources at a first source angle and a second source angle to binuaralize the stereo pair of inputs for more than two source angles, e.g. to create the illusion that a signal that is panned between the stereo pair of inputs is emanating from a source at a third source angle between the first and second source angles.

Figure 3:
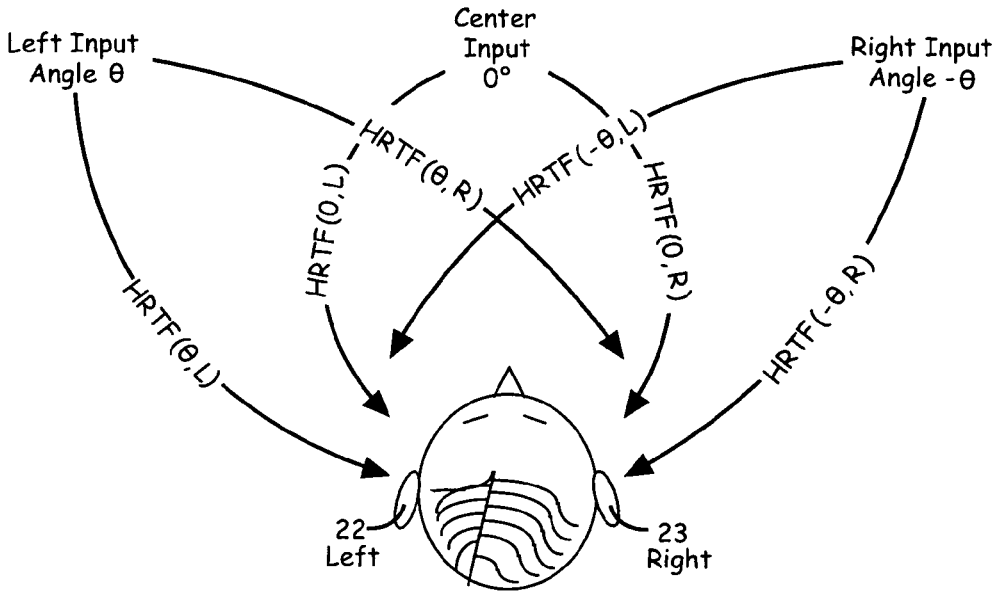
FIG. 3 shows diagrammatically an example of HRTFs for three source angles for, a left virtual speaker, a right virtual speaker, and a center location.

FIG. 3 shows an example of HRTFs for three source angles, a first azimuth angle, denoted θ, for a left virtual speaker, an angle for a right virtual speaker, which in FIG. 3 is −θ under the assumption of symmetry, and a center virtual speaker at an angle of 0 degrees, i.e., half way between the left and right virtual speakers. For the center virtual speaker, the HRTF pair is denoted as the pair HRTF(0,L) and HRTF(0,R) respectively. The left virtual speaker HRTF pair is denoted as the pair HRTF(θ,L) and HRTF(θ,R) respectively, and the right virtual speaker HRTF pair is denoted as the pair HRTF(−θ,L) and HRTF(−θ,R) respectively.

It is desired to binauralize a stereo input so that the sound appears to come from virtual speakers at azimuth angles ±θ. As discussed in the BACKGROUND section, the inventor has found that a center panned signal when played back through a traditional binaural playback system such as that of FIG. 2 for virtual speakers at azimuth angles ±θ. usually provides a listener with an imperfect center image. That is, the binauralizer does not approximate HRTF(0,L) and HRTF(0,R) well.

Figure 1:
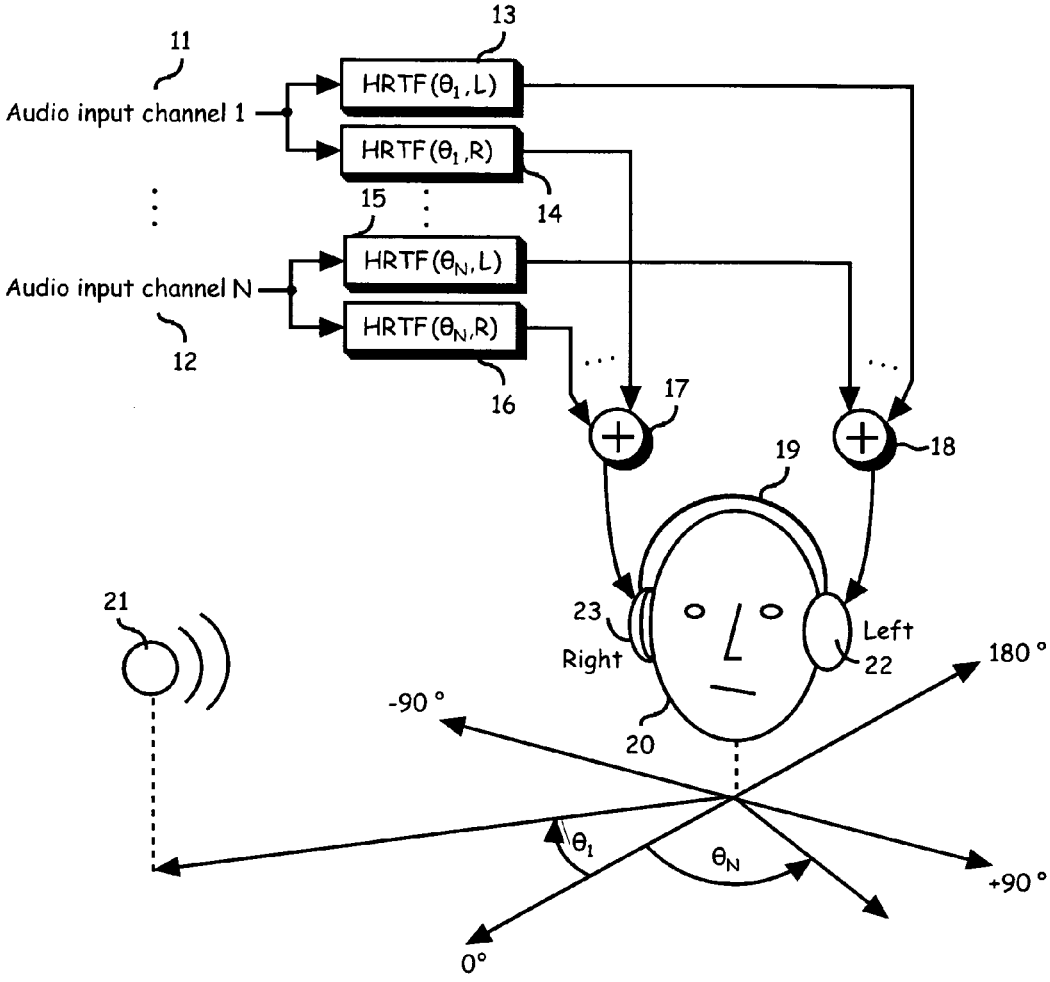
FIG. 1 shows a common binaural playback system that includes processing multiple channels of audio by a plurality of HRTF filters to provide a listener with the impression that each of the input audio channels is being presented from a particular direction. While a binauralizer having the structure of FIG. 1 may be prior art, a binauralizer with filters selected according to one or more of the inventive aspects described herein is not prior art.
Figure 2:
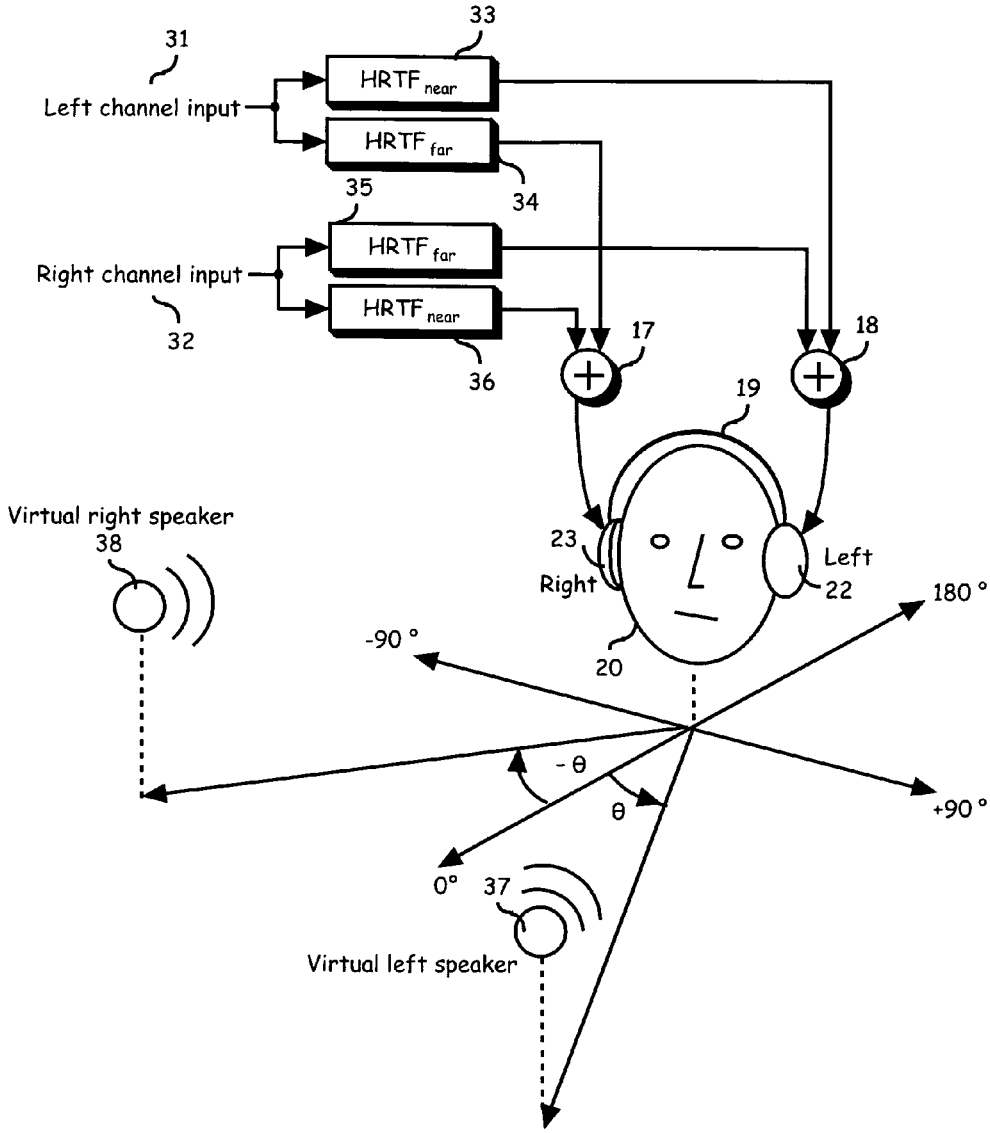
FIG. 2 shows a stereo binauralizer system that includes two audio inputs, a left channel input and a right channel input each processed through a air of HRTF filters. While a binauralizers having the structure of FIG. 1 may be prior art, a binauralizer with filters selected according to one or more of the inventive aspects described herein is not prior art.

Referring to FIG. 2 and Eqs. 1-6. when an input denoted MonoInput is split between the left and right channel inputs and processed by the stereo-binaural system of FIG. 2, the stimulus at the listener's left and right ears, LeftEar and RightEar, respectively are, assuming symmetry:

$$LeftEar = RightEar = \frac{HRTF_{near} + HRTF_{far}}{2} \otimes MonoInput \tag{7}$$

It is desired that:

$$\text{LeftEar}=\text{HRTF}(0,L)\otimes\text{MonoInput}$$

$$\text{RightEar}=\text{HRTF}(0,R)\otimes\text{MonoInput}' \tag{8}$$

so that the listener has the illusion that the MonoInput emanated from a center location. Assume that the HRTF measurements exhibit perfect symmetry. Thus, assume that HRTF(0,L)=HRTF(0,R), and denote this quantity as $HRTF_{ctr}$. It is therefore desired that for the signal split into the left and right inputs, $$\text{LeftEar}=\text{RightEar}=\text{HRTF}_{ctr} \otimes \text{MonoInput}. \tag{9}$$

Comparing Eqs. 7 and 9. to provide the listener with the correct perception of the direction of MonoInput, termed a good "phantom center image," it is desired that:

$$\frac{HRTF_{near} + HRTF_{far}}{2} = HRTF_{ctr}. \tag{10}$$

According to a first embodiment of the invention, an equalizing filter is applied to the inputs. By restricting the equalizing filter to be a linear time invariant filter, the filtering of such an equalizing filter may be applied (a) to the left and right channel input signals prior to binauralizing, or (b) to the measured or assumed HRTFs for the listener for the left and right virtual speaker locations, such that the average of the resulting near and far HRTFs approximates the desired phantom center HRTF. That is, $$\frac{HRTF'_{near} + HRTF'_{far}}{2} \approx HRTF_{ctr} \tag{11}$$

where $HRTF'_{near}$ and $HRTF'_{far}$ are the $HRTF_{near}$ and $HRTF_{far}$ filters that include equalization.

Denote by $EQ_C$ the equalizing filter response. e.g., impulse response. Applying this filter to the left and right channel inputs prior to binauralizing is equivalent to binauralizing with $HRTF'_{near}$ and $HRTF'_{far}$ filters determined from the θ and −θ HRTF pairs denoted $HRTF_{near}$ and $HRTR_{far}$, and the equalizing filter as follows, assuming symmetry:

$$HRTF'_{near}=HRTF_{near} \otimes EQ_C$$

$$HRTF'_{far}=HRTF_{far} \otimes EQ_C \tag{12}$$

Combining with Eq. 11. leads to the desired relationship:

$$\frac{HRTF'_{near} \otimes EQ_c + HRTF'_{far} \otimes EQ_c}{2} = HRTF_{ctr} \tag{13}$$

In one embodiment, the equalizing filter is obtained by an equalizing filter that is the combination of the desired HRTF filter and an inverse filter. In particular, Eq. 13 is satisfied by an equalizing filter given by:

$$EQ_c = HRTF_{ctr} \otimes \text{inverse}\left(\frac{HRTF_{near} + HRTF_{far}}{2}\right), \tag{14}$$

where inverse( ) denoted the operation of inverse filtering, such that, if X and Y are filters specified in the time domain, e.g., as impulse responses, Y=inverse(X) implies Y⊗X is a delta function, where ⊗ is convolution.

Many methods are known in the art for constructing an inverse filter. Inverse filtering is also known in the art as deconvolution. In a first implementation, where X and Y are for FIR filters specified by a finite length vector representing the impulse response, one forms a Toeplitz matrix based on Y, denoted Toeplitz(Y). The vector X is a finite length vector chosen so that Toeplitz(Y)⊗Toeplitz(X) is close to a delta function. That is, Toeplitz(Y) Toeplitz(X) is close to an identity matrix, with error being minimized in a least squares sense. In one implementation, one uses iterative method to determine such inverse.

The present invention is not restricted to any particular method of determining the inverse filter. One alternate method structures the inverse filtering problem as an adaptive filter design problem. A FIR filter of impulse response X, length $m_1$ is followed by a FIR filter of impulse response Y of length $m_2$. A reference output of delaying an input is subtracted from the output of the cascaded filters X and Y to produce an error signal. The coefficients of Y are adaptively changed to minimize the mean squared error signal. This is a standard adaptive filter problem, solved by standard methods such as the least mean squared (LMS) method, or a variation called the normalized LMS method. See for example, S. Haykim, "Adaptive Filter Theory," 3rd Ed., Englewood Cliffs, N.J.: Prentice Hall, 1996. Other inverse filtering determining methods also may be used.

Yet another embodiment of the inverse filter is determined in the frequency domain. The inventor produces a library of HRTF filters for use with binauralizers. These predetermined HRTF filters are known to behave smoothly in the frequency domain, such that their frequency responses are known to be invertible to produce a filter whose frequency response is the inverse of that of the HRTF filter. The method of creating an inverse filter is to invert $$\frac{HRTF_{near} + HRTF_{far}}{2}$$

for such HRTF filters are known to be well behaved.

In yet another embodiment, the filter $$\frac{HRTF_{near} + HRTF_{far}}{2}$$

is inverted in the frequency domain as follows:

1) Transform the impulse response to the frequency domain.
2) Apply a smoothing to the amplitude response, e.g., in a logarithmic frequency domain scale, e.g., on ⅓ octave resolution. The smoothing is to force the smoothed amplitude response to be well behaved, and thus to be invertible.
3) Invert the smoothed amplitude response.
4) Add phase response to the inverted smoothed amplitude filter such that the resulting filter is a minimum phase filter. The original phase of the filter prior to inversion is not used.

Thus, a first embodiment includes using an equalization filter denoted $EQ_C$, that in one embodiment is computed as:

$$EQ_C = HRTF_{ctr} \otimes \text{inverse}\left(\frac{HRTF_{near} + HRTF_{near}}{2}\right)$$

to modify the $HRTF_{near}$ and $HRTF_{far}$ to create equalized HRTF filters $HRTF'_{near}$ and $HRTF'_{far}$ are now no longer equal to HRTF(θ,L) and HRTF(θ,R), i.e., $HRTF_{near}$ and $HRTF_{far}$ as would be ideal. Instead, the left and right channel audio input signals now have an overall equalization applied to them.

In general, this equalization has been found to not cause undue deterioration of the overall process, in that listeners do not perceive the left and right virtual speaker sounds to be bad.

The resulting equalized HRTF pair, $HRTF'_{near}$ and $HRTF'_{far}$ satisfy the following criteria:

1. The response of the system, when the input signal is panned fully to the left or right is equivalent to the desired HRTF response for the selected sound source locations denoted θ and −θ, but with a relatively benign overall equalization, $EQ_C$, applied.
2. The response of the system, when the input signal is center panned, is very close to the HRTF response for a 0° source.

Figure 4A:
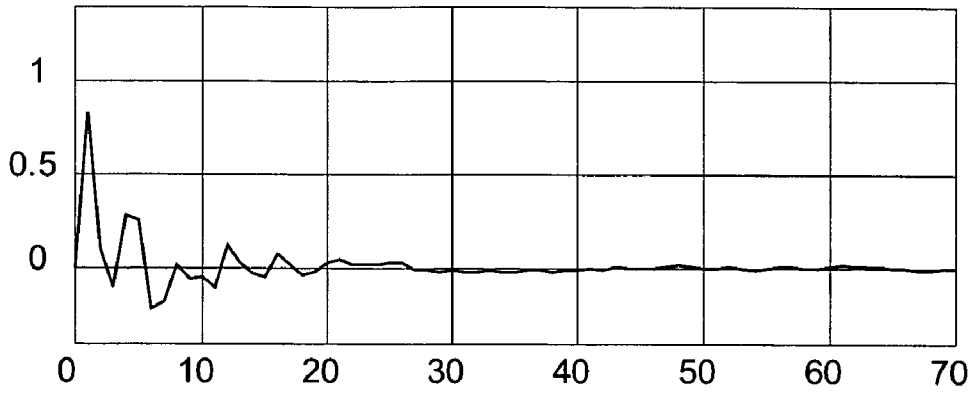
FIGS. 4A, 4B, 4C, and 4D illustrate some typical HRTF filters for use in a binauralizer to place virtual speakers at θ=±45°.
Figure 4B:
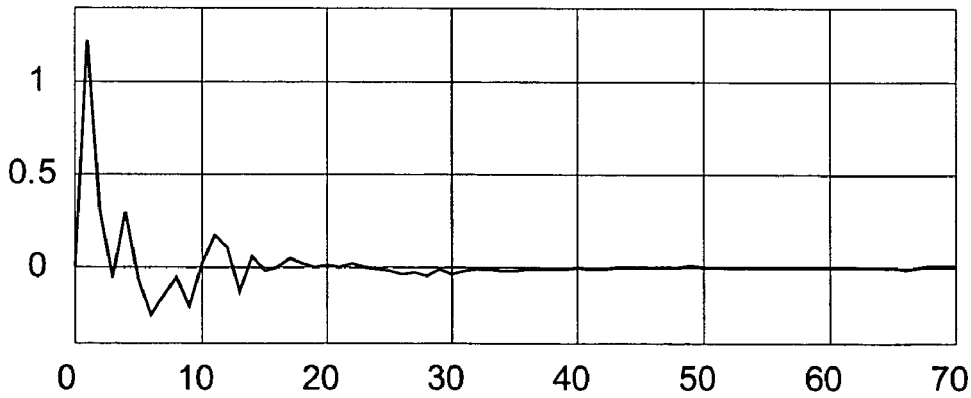
Figure 4C:
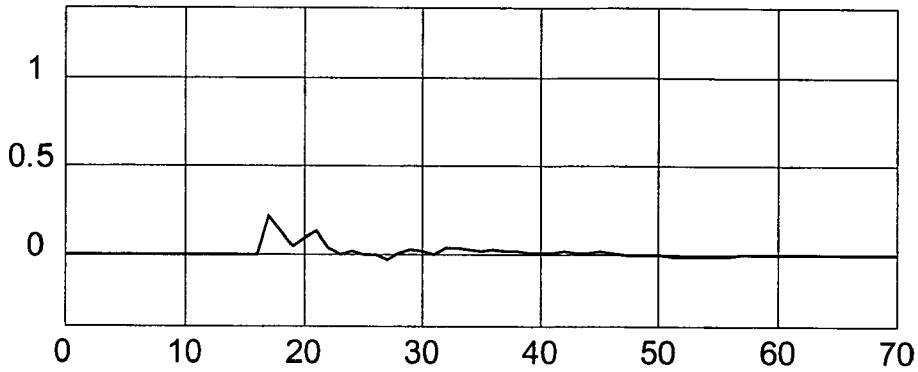
Figure 4D:
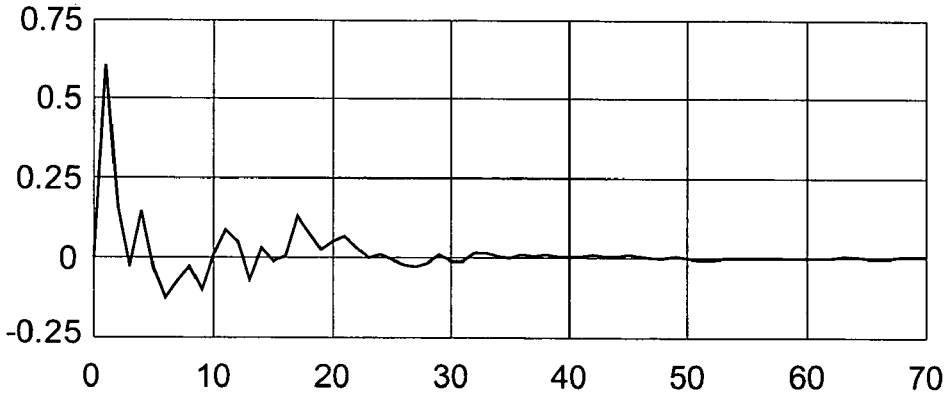

FIGS. 4A, 4B, 4C, and 4D illustrate some typical HRTF filters for use in a binauralizer to place virtual speakers at θ=±45°. FIG. 4A shows the measured 0° HRTF, which is the desired center filter denoted $HRTF_{center}$, FIG. 4B shows the measured 45° near ear HRTF, $HRTF_{near}$ used in the binauralizer. FIG. 4C shows the measured 45° far ear HRTF, $HRTF_{far}$ used in the binauralizer, and FIG. 4D shows the average of the near and far ear 45° HRTFs. It can be seen the sum of the near and far HRTFs does not match the desired 0° HRTF.

Figure 5A:
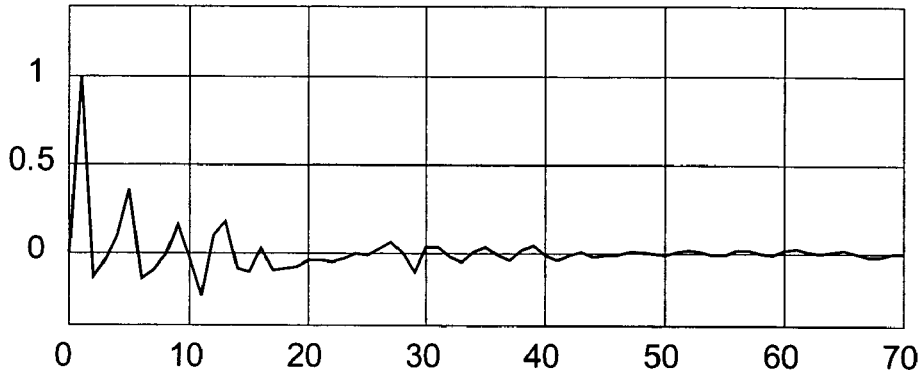
FIGS. 5A-5D show how equalization can be used to modify the near and far HRTF filters such that the sum more closely matches the desired 0° HRTF.
Figure 5B:
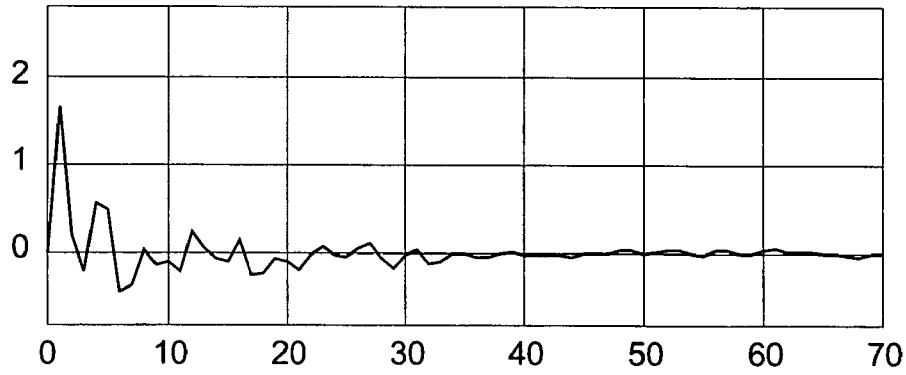
Figure 5C:
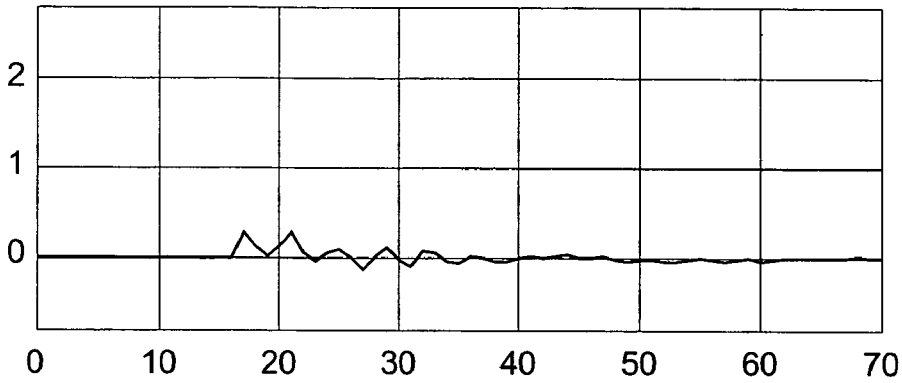
Figure 5D:
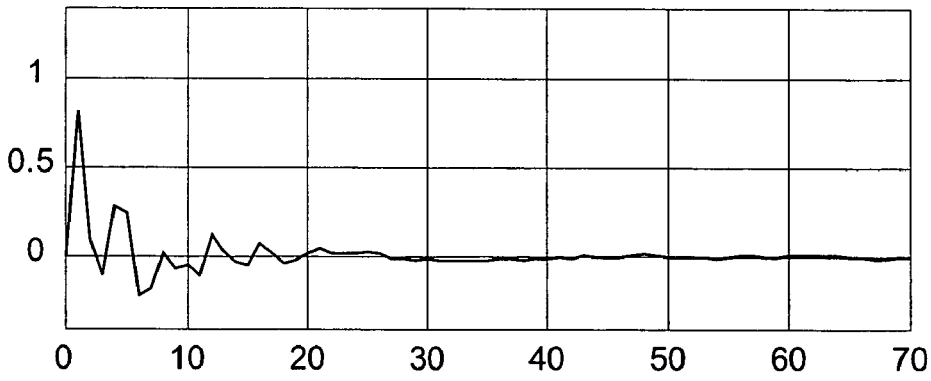

FIGS. 5A-5D show how equalization can be used to modify the near and far HRTF filters such that the sum more closely matches the desired 0° HRTF. FIG. 5A shows the impulse response of the equalization filter $EQ_C$ to be applied to $HRTF_{near}$ and $HRTF_{far}$. FIG. 5B shows the 45° near ear HRTF after equalization, that is, $HRTF'_{near}$. FIG. 5C shows the 45° far ear HRTF after equalization, that is, $HRTF'_{near}$, and FIG. 5D shows the resulting average of the equalized near HRTF and equalized far HRTFs. Comparing FIG. 5D with FIG. 4A, it can be seen that the average of the equalized near and far HRTFs closely matches the measured 0° HRTF.

Figure 6:
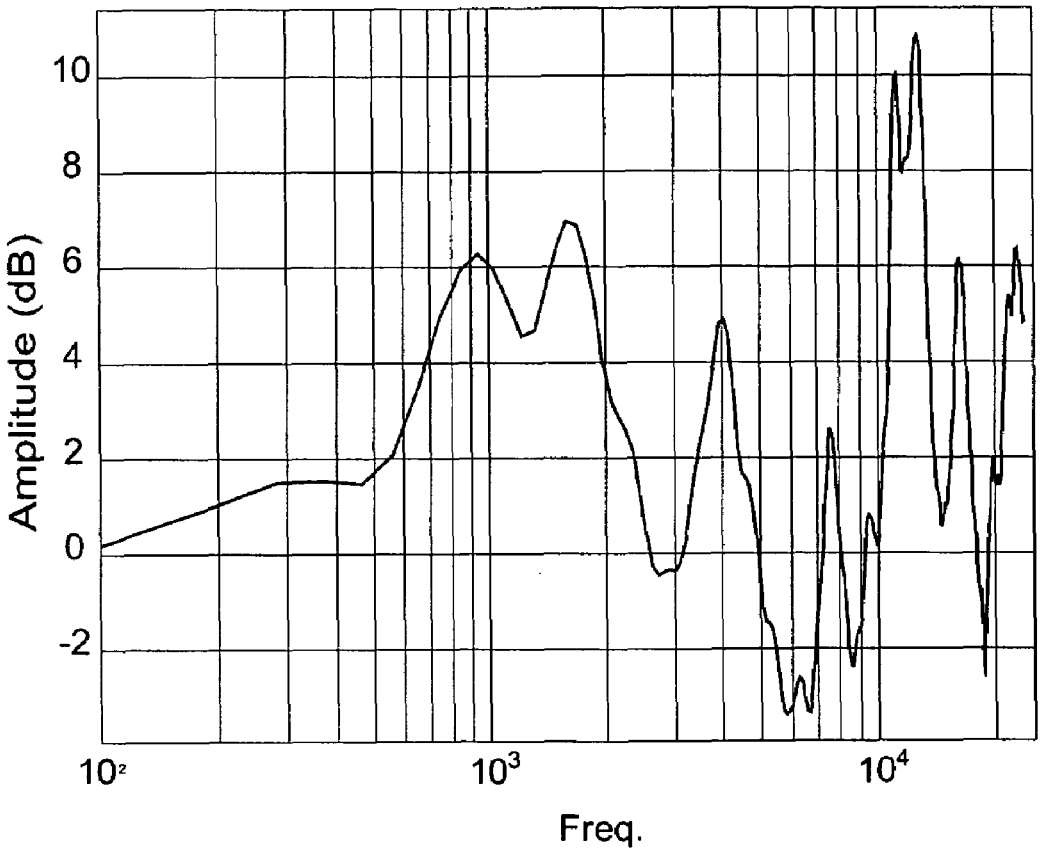
FIG. 6 shows the frequency magnitude response of an equalization filter designed according to an aspect of the present invention.

FIG. 6 shows the frequency magnitude response of the equalization filter $EQ_C$.

Figure 7:
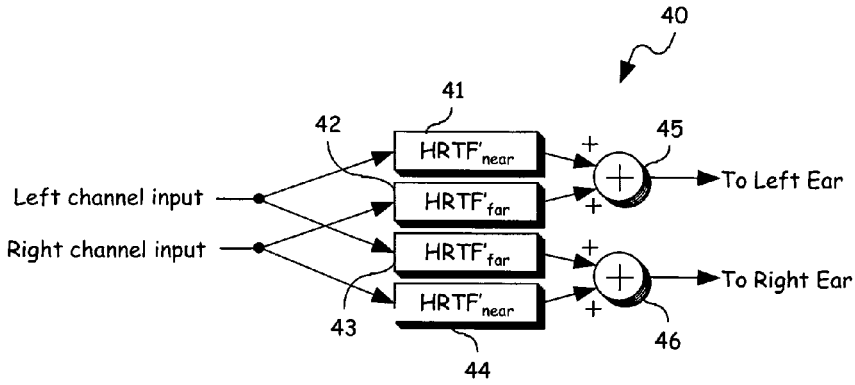
FIGS. 7 shows a first embodiment of a binauralizer using equalized HRTF filters determined according to aspects of the present invention.
Figure 8:
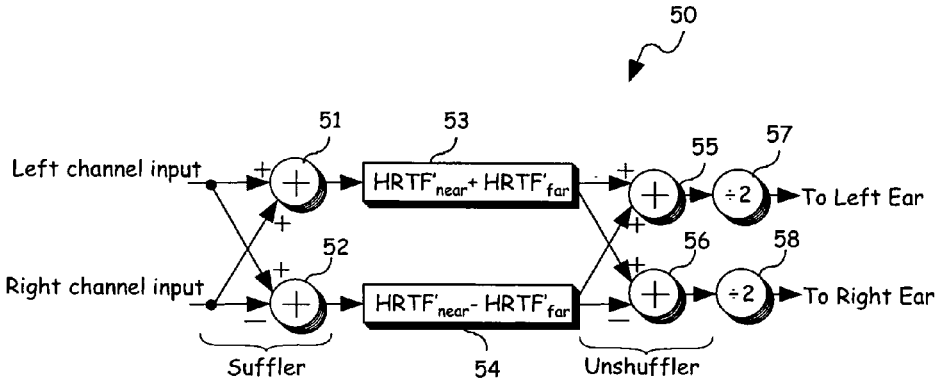
FIG. 8 shows a second embodiment of a binauralizer using equalized HRTF filters determined according to aspects of the present invention using a shuffler network (a "shuffler").

Once one determines the filter coefficients for FIR filters $HRTF'_{near}$ and $HRTF'_{far}$, FIGS. 7 and 8 show two alternate implementations of binauralizers using such determined equalized HRTF filters. FIG. 7 shows a first implementation 40 in which four filters: two near filters 41 and 44 of impulse responses $HRTF'_{near}$ and two far filters 42 and 43 of impulse responses $HRTF'_{far}$ are used to create signals to be added by adders 45 and 46 to produce the left ear signal and right ear signal.

FIG. 8 shows a second implementation 50 that uses the shuffler structure first proposed by Cooper and Bauck. See for example, U.S. Pat. No. 4,893,342 to Cooper and Bauck titled HEAD DIFFRACTION COMPENSATED STEREO SYSTEM. A shuffler that includes an adder 51 and a subtractor 52 produces a first signal which is a sum of the left and right audio input signals, and a second signal which is the difference of the left and right audio signals. In the shuffler implementation 50, only two filters are required, a sum filter 53 having an impulse response $HRTF'_{near}+HRTF'_{far}$ for the first shuffled signal: the sum signal, and a difference filter 54 having an impulse response $HRTF'_{near}-HRTF'_{far}$ for the second shuffled signal: the difference signal. The resulting signals are now unshuffled in an unshuffler network (an "unshuffler") that reverses the operation of a shuffler, and includes an adder 55 to produce the left ear signal, and a subtractor 56 to produce the right ear signal. Scaling may be included, e.g., as divide by two attenuators 57 and 58 in each path, or a series of attenuators split at different parts of the circuit.

Note in FIG. 8 that the sum filter 53 has an impulse response that by equalizing the near and far HRTFs is approximately equal to the desired center HRTF filter response, $2*HRTF_{center}$. This makes sense, since the sum filter followed by the unshuffler network 55, 56 and attenuators 57, 58 is basically an HRTF filter pair for a center panned signal.

In an alternate method, rather than pre-equalize the near and far HRTFs, a shuffler structure similar to FIG. 8 is used, but with the sum filter replaced by double the desired center HRTF filter.

Figure 9:
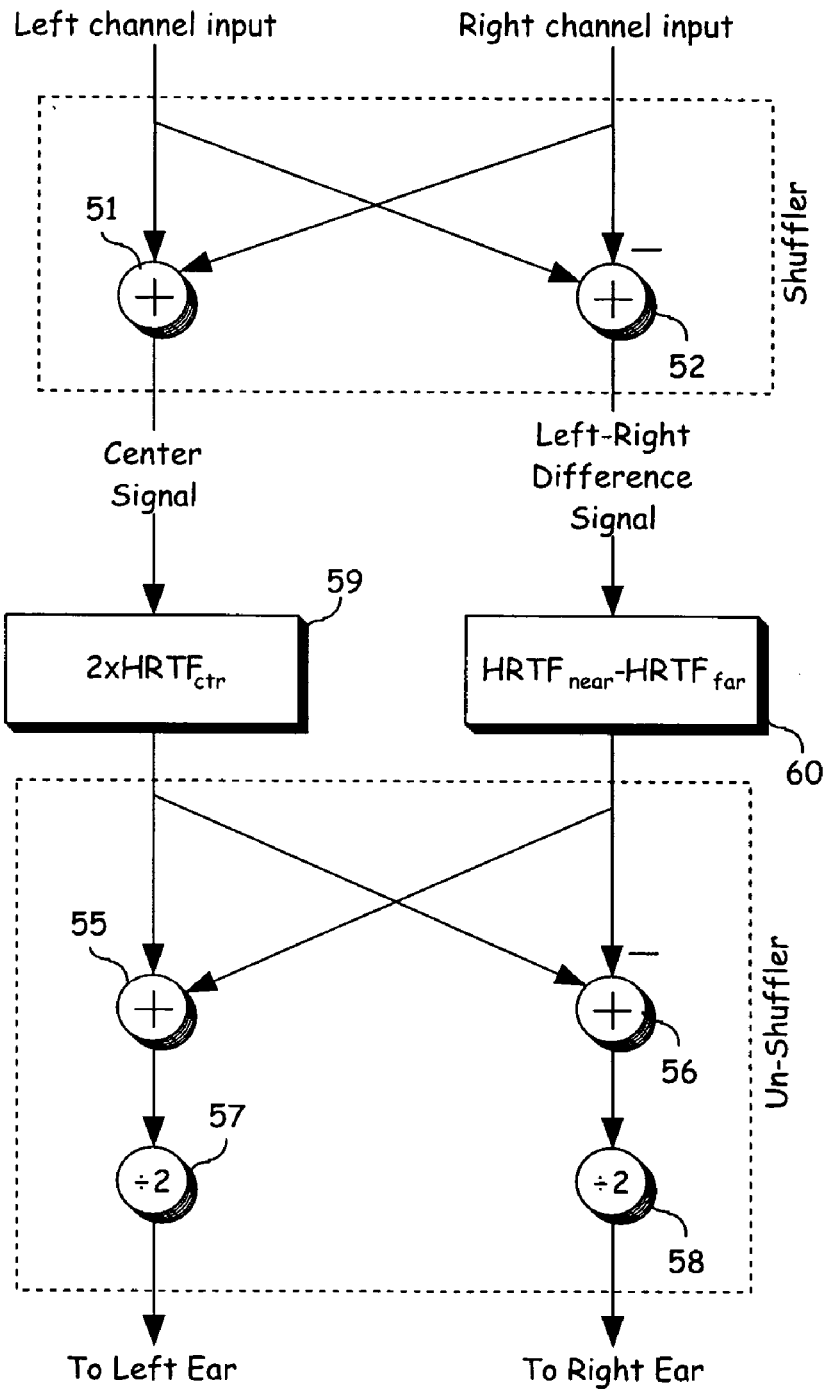
FIG. 9 shows another shuffler embodiment of a binauralizer using a sum signal filter that is the desired center HRTF filter, according to an aspect of the invention.

Such an implementation is shown in FIG. 9 and corresponds to:

Processing the first signal from the shuffler, i.e., the sum signal proportional to the sum of the left and right channel inputs, using a filter that forms a localized center virtual speaker image for a center panned signal component.

Processing the second signal from the shuffler, i.e., the difference signal proportional to the sum of the left and right channel inputs, so that the left and right inputs are approximately processed so as to localize at a desired left and a desired right virtual speaker locations.

The embodiment of FIG. 9 achieves this by using a shuffler network that includes the adder 51 and subtractor 52 to produce the center and difference signals. While the embodiment of FIG. 9 uses Left and Right equalized HRTFs, then converts them into the sum and difference of the equalized HRTFs, the embodiment of FIG. 9 replaces the sum filter with a sum filter 59 that has twice the desired center HRTF response, and uses for the difference filter 60 a response equal to the unequalized difference filter. This method provides the desired high-quality center HRTF image, at the expense of some localization error in the Left and Right signals.

Therefore, presented have been a first and a second set of embodiments as follows:

1. Starting with the near and far virtual speaker HRTF's, apply equalization filtering to these near and far virtual speaker HRTF's, so as to force the sum of the near and far HRTF's to approximate twice the desired center HRTF. This provides a listener with the desired high-quality center HRTF image, at the expense of some equalization variation in the perceived left and right signals. Such equalization error has been found to not be unpleasing.
2. Starting with the near and far virtual speaker HRTF's, and the desired center HRTF, determine the difference filter as the difference of the near and far HRTF filters. Construct a sum signal and difference signal, e.g., using a shuffler network. Apply the desired center HRTF filter to the sum signal, and apply a filter with a response proportional to the difference of the near and far speaker HRTF filters to the difference signal. Unshuffle the resulting two filtered signals and apply to the left and right ears, e.g., via headphones. This provides a listener with the desired high-quality center image, at the expense of some localization error in the left and right virtual speaker signals.

A third set of embodiments combines the two versions 1. and 2. as follows:

3. Use the method numbered 1 above to produce sum and difference filters based on equalized near and far HRTFs. Average the sum of the equalized filter responses with the desired center HRTF to produce an averaged sum signal filter. Average the difference of the equalized filter responses with the difference of the unequalized HRTF filters to produce an averaged difference signal filter. Construct a sum signal and difference signal, e.g., using a shuffler network. Apply the desired average sum filter to the sum signal, and apply the averaged difference signal filter to the difference signal.

Unshuffle the resulting two filtered signals and apply to the left and right ears, e.g., via headphones. This provides a listener with the desired high-quality center HRTF image, at the expense of some EQ variation and some localization error in the Left and Right signals.

Other alternate embodiments are possible to provide a compromise between the quality of the center image and the quality of the left and right images. In a first such embodiment, the equalization filter, e.g., that of FIG. 6 for the virtual speakers at ±45°, is modified, so as to be only partially effective, resulting in a set of HRTFs that have a slightly less clear center image than the HRTFs described in the first above-described set of embodiments, but with the advantage that the left and right signals are not colored as much as would occur with the equalized HRTF filters described in the first above-described set of embodiments.

As a more specific example, an equalizer is produced by halving (on a dB scale) the equalization curve of FIG. 6 so that, at each frequency, the effect of the filter is halved, and likewise, the equalization filter's phase response (not shown) is halved, while maintaining the well-behaved phase response, e.g., maintaining a minimum phase filter. The resulting filter is such that a pair of such equalization filters cascaded provide the same response as the filter shown in FIG. 6. This equalization filter is used to equalize the desired, e.g., measured HRTF filters for the desired speaker locations. When the resulting signals are played back to a listener, the inventor found that the resulting near and far equalized HRTF filters exhibit a partly improved center image, but suffer only less equalization error in the left and right images.

Larger Speaker Angles

While the description above shows the technique used for placing virtual L and R speakers in front of the listener, e.g., ±30 degrees, or ±45 degrees, the method and apparatus described herein works also for larger virtual speaker angles, even up to ±90 degrees. With reproduction using actual loudspeakers, placing the loudspeakers close to ±90 degrees to the listener, e.g., directly to the left and right of the listener does not correctly localize a center signal created by panning, e.g., center panning created by equally dividing a mono signal between the left and right speakers in such a case does not properly create a phantom center image for stereo speaker playback. In the case of playback through actual speakers, such center panning is known to correctly create the location of the center for a listener, i.e., to create a phantom center image for stereo speaker playback, only when the stereo speakers are placed symmetrically in front of the listener at no more than about ±45 degrees to the listener. Aspects of the present invention provide for playback though headphones with front-center image location the virtual left/right speakers are up to +/−90 degrees to the listener.

Playback Through Speakers

The methods and apparatuses described above using HRTF filters are not only applicable for binaural headphone playback, but may be applied to stereo speaker playback. Techniques for creating the effect of sound localization via speakers, i.e., techniques for creating phantom sound source images via speaker playback are well known in the art, and are commonly referred to as "cross-talk cancelled binaural" techniques and "transaural" filters. See, for example, U.S. Pat. No. 3,236,949 to Atal and Schroeder titled APPARENT SOUND SOURCE TRANSLATOR. Crosstalk refers to the crosstalk between the left and right ear of a listener during listening, e.g., crosstalk between the output of a speaker and the ear furthest from the speaker. For example, for a stereo pair of speakers placed in front of a listener, crosstalk refers to the left ear hearing sound from the right speaker, and also to the right ear hearing sound from the left speaker. Because normal sound cues are disturbed by crosstalk, crosstalk is known to significantly blur localization. Crosstalk cancellation reverses the effect of crosstalk.

For a mono input, a typical cross-talk-cancelled filter includes two filters that process the mono input signal to two speakers, usually placed in front of the listener like a regular stereo pair, with the signals at the speakers intended to provide a stimulus at the listener's ears that corresponds to a binaural response attributable to a sound arrival from a virtual sound location.

As an example, consider two actual speakers that are located at ±30° angles in front of a listener, and suppose it is desired to provide the listener with the illusion of a sound source at +60°. Cross-talk cancelled binauralization achieves this by both "undoing" the ±30° degree HRTFs that are imparted by the physical speaker setup, and binauralizing using 60 degree HRTF filters.

Whilst these cross-talk-cancelling techniques can be applied to create almost any virtual source angle in front of the listener (virtual source locations behind the listener are very difficult to attain), the 0 degree front image is still typically created by the more common method of splitting an input between the two speakers, called center panning, rather than by using HRTFs, so that the mono input to be centrally located by a listener is fed to the left and right speakers with around 3 to 6 dB of attenuation.

Figure 10:
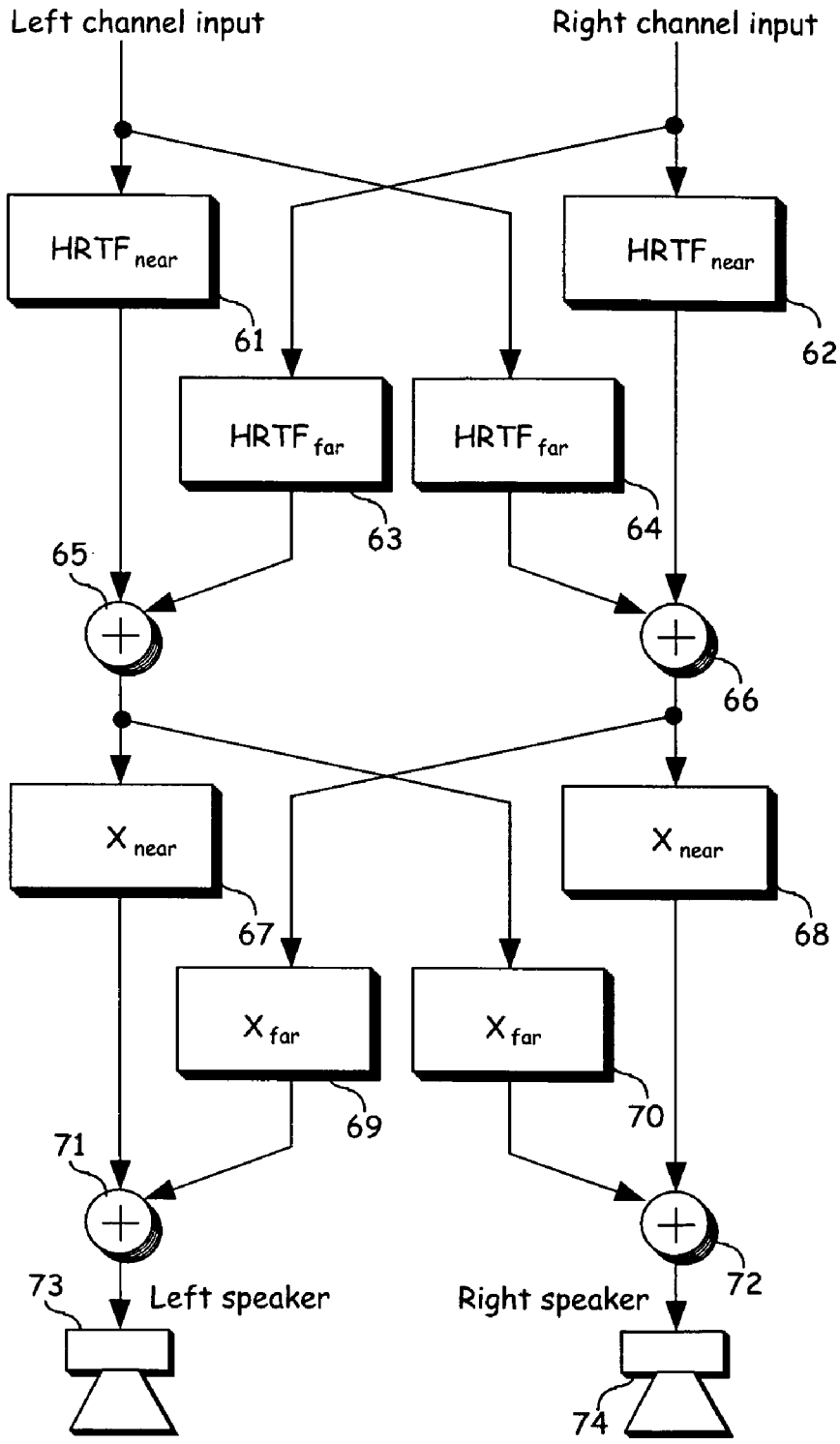
FIG. 10 shows a crosstalk cancelled binauralizing filter embodiment including a cascade of a binauralizer to place virtual speakers at the desired locations, and a cross talk canceller. The binauralizer part incorporates aspects of the present invention.

Suppose it is desired to process a stereo input signal pair for playback over speakers that are located at some angles, e.g., at ±30° in front of a listener, and suppose it is desired to provide the listener with the illusion of listening to a pair of speakers located elsewhere, e.g., at ±60° angles in front of the listener. One prior art method of achieving this is to create a crosstalk cancelled binauralizer. FIG. 10 shows such a crosstalk cancelled binauralizing filter implemented as a cascade of a binauralizer to place virtual speakers at the desired locations, e.g., at ±60°. The binauralizer includes in the symmetric case (or forced symmetric case, e.g., per Eq. 3) the two near HRTF filters 61, 62 whose impulse response is denoted $HRTF_{near}$ and the far HRTF filters 63, 64 whose impulse response is denoted $HRTF_{far}$. The outputs of each near and far filter are added by adders 65, 66 to form the left and right binauralized signals. The binauralizer is followed by a cross-talk canceller to cancel the cross talk created at the actual speaker locations, e.g., at ±30° angles. The cross talk canceller accepts the signals from the binauralizer and includes in the symmetric case or forced symmetric case the near crosstalk cancelling filters 67, 68 whose impulse response is denoted $X_{near}$ and the far crosstalk cancelling filters 69, 70 whose impulse response is denoted $X_{far}$, followed by summers 71 and 72 to cancel the cross talk created at the ±30° angles. The outputs are for a left speaker 73 and a right speaker 74.

Figure 11:
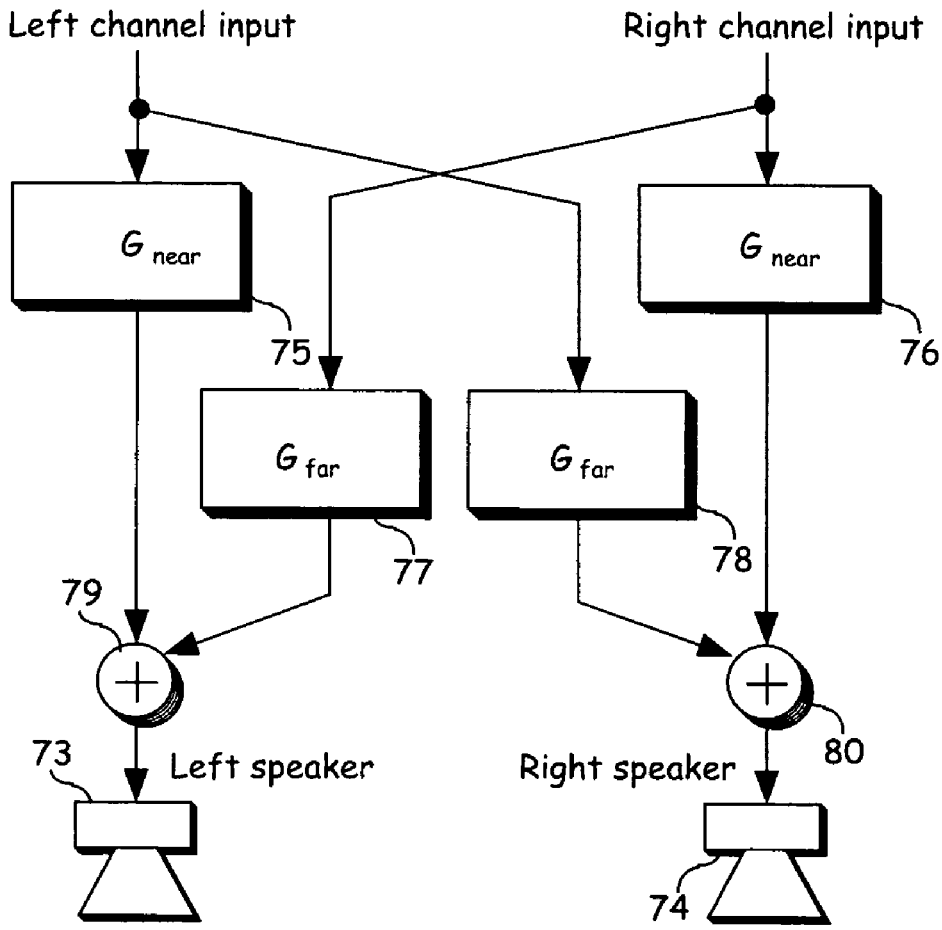
FIG. 11 shows an alternate embodiment of a crosstalk cancelled binauralizing filter that includes four filters.

Because each of the near and far binauralizer and crosstalk cancelling filters is a linear time-invariant system, the cascade of the binauralizer may be represented as a two-input, two output system. FIG. 11 shows an implementation of such a crosstalk cancelled binauralizer as four filters 75, 76, 77, and 78, and two summers 79 and 80. The four filters in the symmetric (or forced symmetric) case, have two different impulse responses: a near impulse response denoted $G_{near}$ for filters 75 and 76, and a far impulse response, denoted $G_{far}$ for filters 77 and 78, wherein each of the $G_{near}$ and $G_{far}$ are functions of the HRTF filters $HRTF_{near}$ and $HRTF_{far}$ and the crosstalk cancelling filters $X_{near}$ and $X_{far}$.

Figure 12:
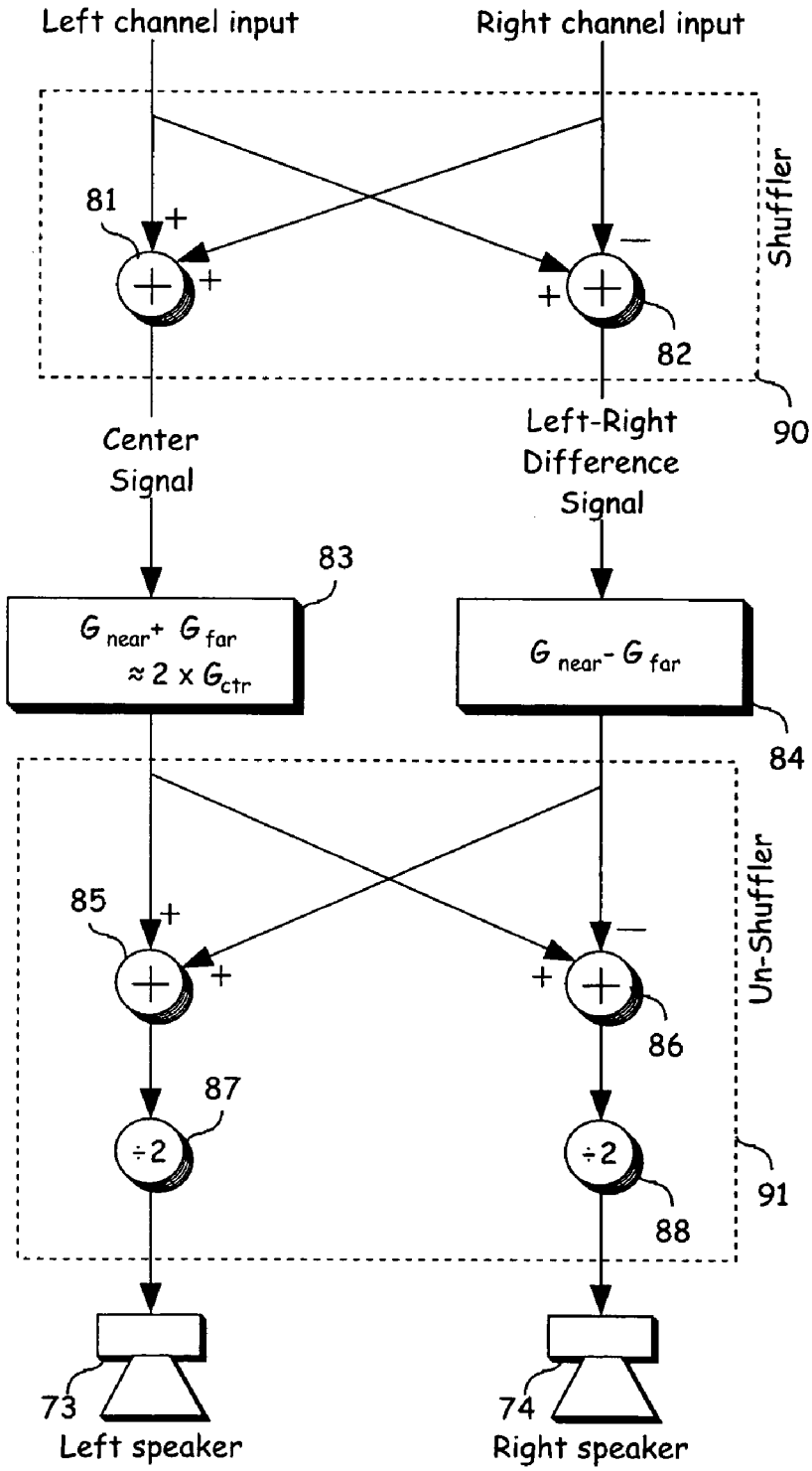
FIG. 12 shows another alternate embodiment of a crosstalk cancelled binauralizing filter that includes a shuffler network, a sum signal filter, and a difference filter network.

As is well known, the two-input, two-output symmetric structure shown in FIG. 11 can also be implemented in a structure shown in FIG. 12. FIG. 12 shows a crosstalk cancelled binauralizer including a shuffling network 90 that has an adder 81 to produce a sum signal and a subtractor 82 to produce a difference signal, a sum signal filter 83 to filter the sum signal, such a sum signal filter having an impulse response proportional to $G_{near}+G_{far}$, a difference filter 84 to filter the difference signal, the difference signal filter having an impulse response proportional to $G_{near}-G_{far}$, followed by an un-shuffling network 91 that also includes a summer 85 to produce the left speaker signal for a left speaker 73 and a subtractor to produce a right speaker signal for a right speaker 74.

Thus, a crosstalk cancelled binauralizing filter is implemented by a structure shown in FIG. 12, which is similar to the structures shown in FIG. 8 and FIG. 9.

In one embodiment, the sum filter is designed to accurately reproduce a source located at the center, e.g., at 0°. Rather than calculate what such a filter is, one embodiment uses a delta function for such a filter, using the knowledge that a listener listening to an equal amount of a mono signal on a left and a right speaker accurately localizes such a signal as coming from the center. In an alternate embodiment, the crosstalk-cancelled filters are equalized to force the sum filter to be approximately the identity filter, e.g., a filter whose impulse response is a delta function. In an alternate embodiment, the sum filter is replaced by a flat (delta function impulse response) filter.

Whereas the binaural applications of the invention are intended to correct 'localization' perception errors, the crosstalk-cancelled application of this invention generally corrects for a commonly perceived equalization errors that occur in the center image.

Rear Virtual Speakers

Another aspect of the invention is correctly simulating a rear center sound source, by binauralizing to simulate speakers at angles ±90 degrees or more, e.g., having two rear virtual speaker locations, further locating a phantom center being localized at the 180 degree (rear-center) position, as if a speaker was located at the rear center position.

In a specific example, consider a binauralizer that produces the effect of a traditional five speaker home theatre. The left and right surround locations of such a "virtual" five-speaker arrangement can be simulated with the added advantage that a clear rear-center image is created. This allows systems that have a rear center speaker, such as Dolby Digital EX™ (Dolby Laboratories, Inc., San Francisco, Calif.) to be simulated.

A first rear signal embodiment includes equalizing the rear near and rear far HRTF filters such that the sum of the equalized rear near and rear far filters approximates the desired rear center HRTF filter. Processing left rear and right rear signals e.g., the surround sound inputs via a binauralizer, using the first rear signal embodiment of pre-equalizing, leads to a headphone perceiving a rear center panned source to appear from the center rear, but the two surround images (rear left and rear right) will sound with some tolerable equalization error. Alternately, by using a binauralizer that uses a shuffler plus a sum signal HRTF filters that approximate a desired center rear HRTF creates playback signals that when reproduced through headphones appear to correctly come from the center, but with the left and right rear signals appearing to come from left and right rear virtual speakers that are slightly off the desired locations.

Another embodiment includes combining front and rear processing to process both rear signals and front signals. Note that surround sound, e.g., four channel sound, is able to process the front left and right signals, and also the rear left and right signals to correctly reproduce a virtual center front sound and a virtual center rear sound.

Note that it will be understood by those skilled in the art that the above filter implementations do not include audio amplifiers, and other similar components. Further, the above implementations are for digital filtering. Therefore, for analog inputs, analog to digital converters will be understood by those in the art to be included. Further, digital-to-analog converters will be understood to be used to convert the digital signal outputs to analog outputs for playback through headphones, or in the transaural filtering case, through loudspeakers.

Furthermore, those in the art will understand that the digital filters may be implemented by many methods.

Figure 13:
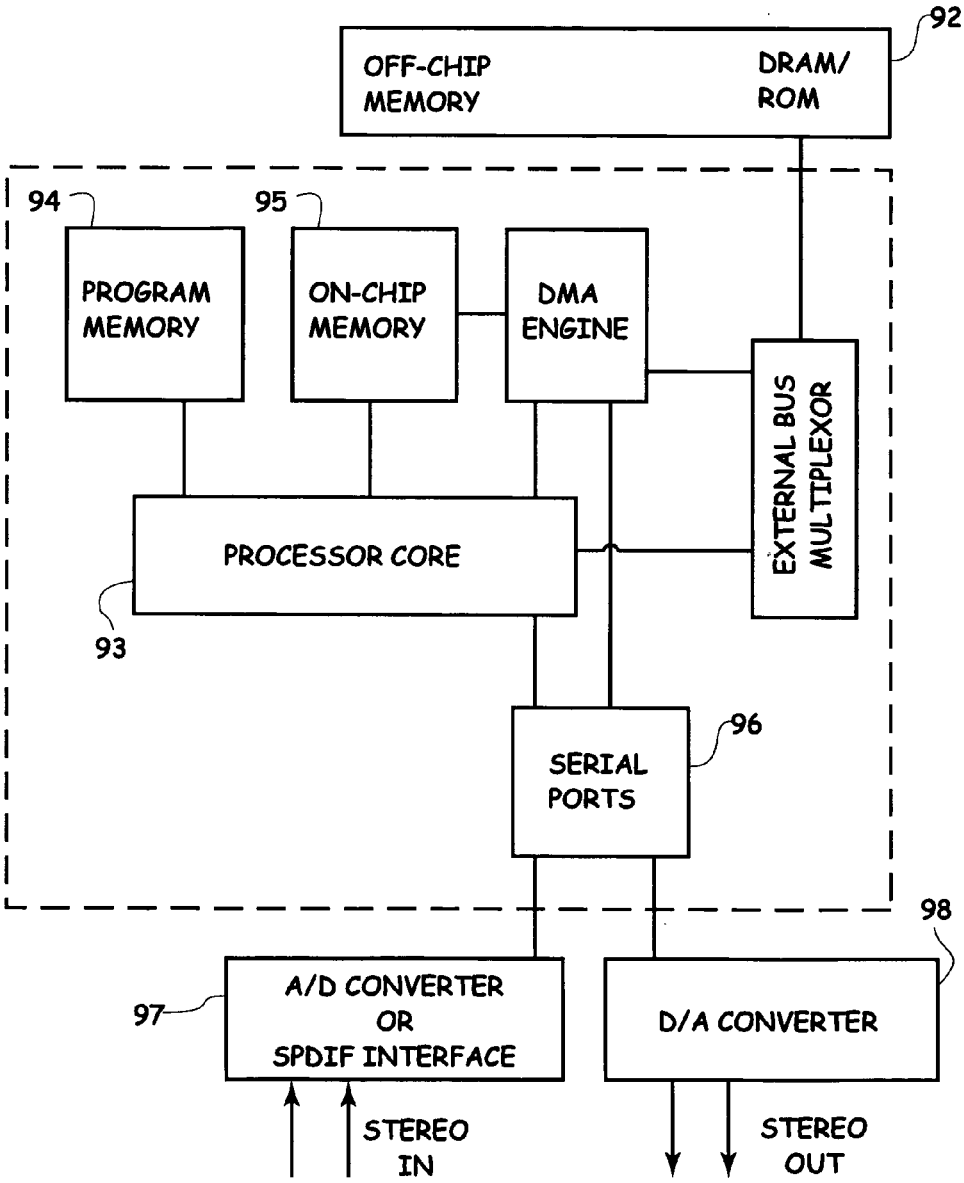
FIG. 13 shows an DSP-device based embodiment of an audio processing system for processing a stereo input pair according to aspects of the invention.

FIG. 13 shows a form of implementation of an audio processing system for processing a stereo input pair according to aspects of the invention. The audio processing system includes: a analog-to-digital (A/D) converter 97 for converting analog inputs to corresponding digital signals, and a digital to analog (D/A) converter 98 to convert the processed signals to analog output signals. In an alternate embodiment, the block 97 includes a SPDIF interface provided for digital input signals rather than the A/D converter. The system includes a DSP device capable of processing the input to generate the output sufficiently fast. In one embodiment, the DSP device includes interface circuitry in the form of serial ports 96 for communicating with the A/D and D/A converters 97,98 without processor overhead, and, in one embodiment, an off-device memory 92 and a DMA engine that can copy data from the off-chip memory to an on-chip memory 95 without interfering with the operation of the input/output processing. The code for implementing the aspects of the invention described herein may be in the off-chip memory and be loaded to the on-chip memory as required. The DSP device includes a program memory 94 including code that cause the processor 93 of the DSP device to implement the filtering described herein. An external bus multiplexor is included for the case that external memory is required.

Figure 14A:
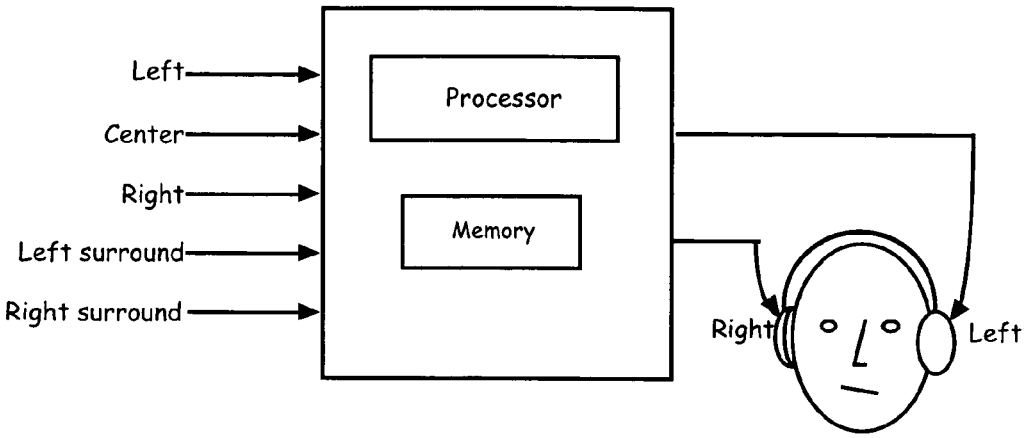
FIG. 14A shows a processing-system-based binauralizer embodiment that accepts five channels of audio information, and includes aspects of the present invention to create the impression to a listener that a rear center panned signal emanates from the center rear of the listener.

Similarly, FIG. 14A shows a binauralizing system that accepts five channels of audio information in the form of a left, center and right signals aimed at playback through front speakers, and a left surround and right surround signals aimed at playback via rear speakers. The binauralizer implements HRTF filter pairs for each input, including, for the left surround and right surround signals, aspects of the invention so that a listener listening through headphones experiences a signal that is center rear panned to be coming from the center rear of the listener. The binauralizer is implemented using a processing system, e.g., a DSP device that includes a processor. A memory in included for holding the instructions, including any parameters that cause the processor to execute filtering as described hereinabove.

Figure 14B:
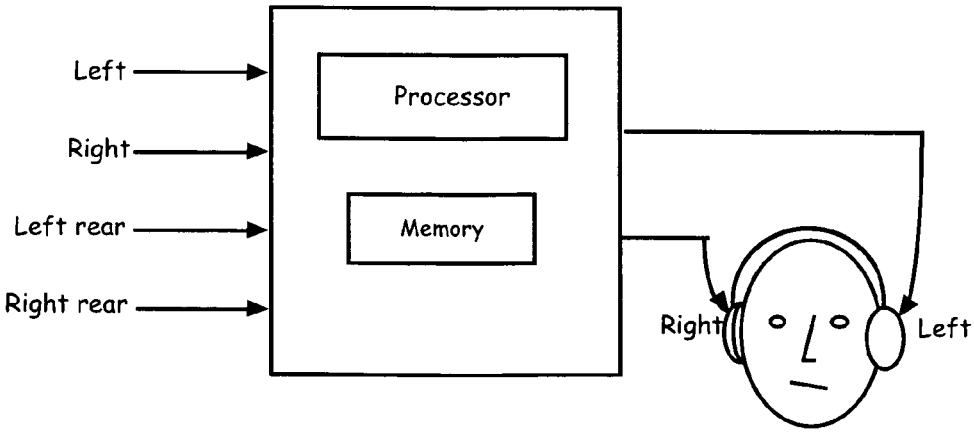
FIG. 14B shows a processing-system-based binauralizer embodiment that accepts four channels of audio information, and includes aspects of the present invention to create the impression to a listener that a front center panned signal emanates from the center front of the listener and that a rear center panned signal emanated from the center rear of the listener.

Similarly, FIG. 14B shows a binauralizing system that accepts four channels of audio information in the form of a left and right from signals aimed at playback through front speakers, and a left rear and right rear signals aimed at playback via rear speakers. The binauralizer implements HRTF filter pairs for each input, including for left and right signals, and for the left rear and right rear signals, aspects of the invention so that a listener listening through headphones experiences a signal that is center front panned to be coming from the center front of the listener, and a signal that is center rear panned to be coming from the center rear of the listener. The binauralizer is implemented using a processing system, e.g., a DSP device that includes a processor. A memory in included for holding the instructions, including any parameters that cause the processor to execute filtering as described hereinabove.

Therefore, the methodologies described herein are, in one embodiment, performable by a machine that includes one or more processors that accept code segments containing instructions. For any of the methods described herein, when the instructions are executed by the machine, the machine performs the method. Any machine capable of executing a set of instructions (sequential or otherwise) that specify actions to be taken by that machine are included. Thus, one typical machine may be exemplified by a typical processing system that includes one or more processors. Each processor may include one or more of a CPU, a graphics processing unit, and a programmable DSP unit. The processing system further may include a memory subsystem including main RAM and/or a static RAM, and/or ROM. A bus subsystem may be included for communicating between the components. If the processing system requires a display, such a display may be included, e.g., a liquid crystal display (LCD) or a cathode ray tube (CRT) display. If manual data entry is required, the processing system also includes an input device such as one or more of an alphanumeric input unit such as a keyboard, a pointing control device such as a mouse, and so forth. The term memory unit as used herein also encompasses a storage system such as a disk drive unit. The processing system in some configurations may include a sound output device, and a network interface device. The memory subsystem thus includes a carrier medium that carries machine readable code segments (e.g., software) including instructions for performing, when executed by the processing system, one of more of the methods described herein. The software may reside in the hard disk, or may also reside, completely or at least partially, within the RAM and/or within the processor during execution thereof by the computer system. Thus, the memory and the processor also constitute a carrier medium carrying machine readable code.

In alternative embodiments, the machine operates as a standalone device or may be connected, e.g., networked to other machines, in a networked deployment, the machine may operate in the capacity of a server or a client machine in a server-client network environment, or as a peer machine in a peer-to-peer or distributed network environment. The machine may be a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine.

Note that while some diagram(s) only show(s) a single processor and a single memory that carries the code, those in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Thus, one embodiment of each of the methods described herein is in the form of a computer program that executes on a processing system, e.g., a one or more processors that are part of binauralizing system, or in another embodiment, a transaural system. Thus, as will be appreciated by those skilled in the art, embodiments of the present invention may be embodied as a method, an apparatus such as a special purpose apparatus, an apparatus such as a data processing system, or a carrier medium, e.g., a computer program product. The carrier medium carries one or more computer readable code segments for controlling a processing system to implement a method. Accordingly, aspects of the present invention may take the form of a method, an entirely hardware embodiment, an entirely software embodiment or an embodiment combining software and hardware aspects. Furthermore, the present invention may take the form of carrier medium (e.g., a computer program product on a computer-readable storage medium) carrying computer-readable program code segments embodied in the medium.

The software may further be transmitted or received over a network via the network interface device. While the carrier medium is shown in an exemplary embodiment to be a single medium, the term "carrier medium" should be taken to include a single medium or multiple media (e.g., a centralized or distributed database, and/or associated caches and servers) that store the one or more sets of instructions. The term "carrier medium" shall also be taken to include any medium that is capable of storing, encoding or carrying a set of instructions for execution by the machine and that cause the machine to perform any one or more of the methodologies of the present invention. A carrier medium may take many forms, including but not limited to, non-volatile media, volatile media, and transmission media. Non-volatile media includes, for example, optical, magnetic disks, and magneto-optical disks. Volatile media includes dynamic memory, such as main memory. Transmission media includes coaxial cables, copper wire and fiber optics, including the wires that comprise a bus subsystem. Transmission media may also take the form of acoustic or light waves, such as those generated during radio wave and infrared data communications. For example, the term "carrier medium" shall accordingly be taken to include, but not be limited to, solid-state memories, optical and magnetic media, and carrier wave signals.

Other embodiments of the invention are in the form of a carrier medium carrying computer readable data for filters to process a pair of stereo inputs. The data may be in the form of the impulse responses of the filters, or of the frequency domain transfer functions of the filters. The filters include two HRTF filters designed as described above. In the case that the processing is for headphone listening, the HRTF filters are used to filter the input data in a binauralizer, and in the case of speaker listening, the HRTF filters are incorporated in a crosstalk cancelled binauralizer.

It will be understood that the steps of methods discussed are performed in one embodiment by an appropriate processor (or processors) of a processing (i.e., computer) system executing instructions (code segments) stored in storage. It will also be understood that the invention is not limited to any particular implementation or programming technique and that the invention may be implemented using any appropriate techniques for implementing the functionality described herein. The invention is not limited to any particular programming language or operating system.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention. Furthermore, while some embodiments described herein include some but not other features, combinations of features of different embodiments are meant to be within the scope of the invention, and form different embodiments, as claimed herein below.

Furthermore, some of the embodiments are described as herein as a method or combination of elements of a method that can be implemented by a processor of a computer system. Thus, a processor with the necessary instructions for carrying out such a method or element of a method forms a means for carrying out the method or element of a method. Similarly, an element described herein of an apparatus embodiment described herein is an example of a means for carrying out the function performed by the element for the purpose of carrying out the invention.

In the description and claims herein, by equality and by substantially equality are included the case of equality to within a constant of proportionality.

All publications, patents, and patent applications cited herein are hereby incorporated by reference.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

I claim:

1. A method comprising:

accepting a pair of audio input signals for audio reproduction;

shuffling the input signals to create a first signal ("sum signal") proportional to the sum of the input signals and a second signal ("difference signal") proportional to the difference of the input signals;

filtering the sum signal through a filter that approximates twice a center head related transfer function ("HRTF") for a listener listening to a virtual sound source at a center location;

filtering the difference signal through a filter that approximates the difference between a near ear HRTF and a far ear HRTF for the listener listening to a pair of virtual speakers; and unshuffling the filtered sum signal and the filtered difference signal to create a first output signal proportional to the sum of the filtered sum and filtered difference signals and a second output signal proportional to the difference of the filtered sum and filtered difference signals, such that in the case that the pair of audio input signals includes a center panned signal component, the listener listening to the first and second output signals through headphones is provided with the sensation that the center panned signal component emanates from the virtual sound source at the center location.

2. A method as recited in claim 1, wherein the filter that approximates twice the center HRTF is obtained as the sum of equalized versions of the near ear HRTF and the far ear HRTF, respectively, obtained by filtering the near ear HRTF and the far ear HRTF, respectively, by an equalizing filter, and wherein the filter that approximates the difference between the near ear HRTF and the far ear HRTF is a filter that has a response substantially equal to the difference between the equalized versions of the near ear HRTF and the far ear HRTF.

3. A method as recited in claim 2, wherein the equalizing filter is an inverse filter for a filter proportional to the sum of the near ear HRTF and the far ear HRTF.

4. A method as recited in claim 3, wherein the equalizing filter response is determined by inverting in the frequency domain a filter response proportional to the sum of the near ear HRTF and the far ear HRTF.

5. A method as recited in claim 3, wherein the equalizing filter response is determined by an adaptive filter method to invert a filter response proportional to the sum of the near ear HRTF and the far ear HRTF.

6. A method as recited in claim 1, wherein the filter that approximates twice the center HRTF is a filter that has a response substantially equal to twice a desired center HRTF.

7. A method as recited in claim 1, wherein the audio input signals include a left input and a right input, wherein the pair of virtual speakers are at a left virtual speaker location and a right virtual speaker location symmetric about the listener, and wherein the listener and listening are symmetric such that near HRTF is the left virtual speaker to left ear HRTF and the right virtual speaker to right ear HRTF, and such that far HRTF is the left virtual speaker to right ear HRTF and the right virtual speaker to left ear HRTF.

8. A method as recited in claim 1, wherein the audio input signals include a left input and a right input, wherein the pair of virtual speakers are at a left virtual speaker location and a right virtual speaker location, and wherein the near HRTF is proportional to the average of the left virtual speaker to left ear HRTF and the right virtual speaker to right ear HRTF, and wherein the far HRTF is proportional to the average of the left virtual speaker to right ear HRTF and the right virtual speaker to left ear HRTF.

9. A method as recited in claim 1, wherein the audio input signals include a left input and a right input, wherein the pair of virtual speakers are at a left front virtual speaker location and a right front virtual speaker location to the front of the listener.

10. A method as recited in claim 9, wherein the left front and right front virtual speaker locations are at azimuth angles of magnitude between 45 and 90 degrees to the listener.

11. A method as recited in claim 1, wherein the audio input signals include a left input and a right input, wherein the pair of virtual speakers are at a left rear virtual speaker location and a right rear virtual speaker location to the rear of the listener.

12. A method as recited in claim 1, wherein the audio input signals are a subset of a set of more than two input signals for surround sound playback, and wherein the method includes processing the set of more than two input signals for listening through headphones, including creating virtual speaker locations for each of the input signals.

13. An apparatus comprising:

means for shuffling a pair of audio input signals, the means for shuffling creating a first signal ("sum signal") proportional to the sum of the input signals and a second signal ("difference signal") proportional to the difference of the input signals;

means for filtering the sum signal through a filter that approximates twice a center head related transfer function ("HRTF") for a listener listening to a virtual sound source at a center location, the means for filtering the sum signal coupled to the means for shuffling;

means for filtering the difference signal through a filter that approximates the difference between a near ear HRTF and a far ear HRTF for the listener listening to a pair of virtual speakers, the means for filtering the difference signal coupled to the means for shuffling; and means for unshuffling the filtered sum signal and the filtered difference signal, the means for unshuffling coupled to the means for shuffling, the means for unshuffling creating a first output signal proportional to the sum of the filtered sum and filtered difference signals and a second output signal proportional to the difference of the filtered sum and filtered difference signals, such that in the case that the pair of audio input signals includes a center panned signal component, the listener listening to the first and second output signals through headphones is provided with the sensation that the center panned signal component emanates from the virtual sound source at the center location.

14. An apparatus as recited in claim 13, wherein the filter that approximates twice the center HRTF is obtained as the sum of equalized versions of the near ear HRTF and the far ear HRTF, respectively, obtained by filtering the near ear HRTF and the far ear HRTF, respectively, by an equalizing filter, and wherein the filter that approximates the difference between the near ear HRTF and the far ear HRTF is a filter that has a response substantially equal to the difference between the equalized versions of the near ear HRTF and the far ear HRTF.

15. An apparatus as recited in claim 14, wherein the equalizing filter is an inverse filter for a filter proportional to the sum of the near ear HRTF and the far ear HRTF.

16. An apparatus as recited in claim 15, wherein the equalizing filter response is determined by inverting in the frequency domain a filter response proportional to the sum of the near ear HRTF and the far ear HRTF.

17. An apparatus as recited in claim 15, wherein the equalizing filter response is determined by an adaptive filter method to invert a filter response proportional to the sum of the near ear HRTF and the far ear HRTF.

18. An apparatus as recited in claim 13, wherein the filter approximates twice the center HRTF is a filter that has a response substantially equal to twice a desired center HRTF.

19. An apparatus as recited in claim 13, wherein the audio input signals include a left input and a right input, wherein the pair of virtual speakers are at a left virtual speaker location and a right virtual speaker location symmetric about the listener, and wherein the listener and listening are symmetric such that near HRTF is the left virtual speaker to left ear HRTF and the right virtual speaker to right ear HRTF, and such that far HRTF is the left virtual speaker to right ear HRTF and the right virtual speaker to left ear HRTF.

20. An apparatus as recited in claim 13, wherein the audio input signals include a left input and a right input, wherein the pair of virtual speakers are at a left virtual speaker location and a right virtual speaker location, and wherein the near HRTF is proportional to the average of the left virtual speaker to left ear HRTF and the right virtual speaker to right ear HRTF, and wherein the far HRTF is proportional to the average of the left virtual speaker to right ear HRTF and the right virtual speaker to left ear HRTF.

21. An apparatus as recited in claim 13, wherein the audio input signals include a left input and a right input, wherein the pair of virtual speakers are at a left front virtual speaker location and a right front virtual speaker location to the front of the listener.

22. An apparatus as recited in claim 21, wherein the left front and right front virtual speaker locations are at azimuth angles of magnitude between 45 and 90 degrees to the listener.

23. An apparatus as recited in claim 13, wherein the audio input signals include a left input and a right input, wherein the pair of virtual speakers are at a left rear virtual speaker location and a right rear virtual speaker location to the rear of the listener.

24. An apparatus as recited in claim 13, wherein the audio input signals are a subset of a set of more than two input signals for surround sound playback, and wherein the apparatus further includes means for processing the set of more than two input signals for listening through headphones, the means for processing also creating virtual speaker locations for each of the input signals.

25. An apparatus comprising:

a shuffler having inputs to accept a pair of audio input signals to create a first signal ("sum signal") proportional to the sum of the input signals and a second signal ("difference signal") proportional to the difference of the input signals, the shuffler having a sum signal output and a difference signal output;

a sum filter coupled to the sum signal output to filter the sum signal to approximates twice a center head related transfer function ("HRTF") for a listener listening to a virtual sound source at a center location;

a difference filter coupled to the difference signal output to filter the difference signal, the difference filter approximating the difference between a near ear HRTF and a far ear HRTF for the listener listening to a pair of virtual speakers; and an unshuffler coupled to the outputs of the sum filter and the difference filter to create a first output signal proportional to the sum of the filtered sum and filtered difference signals and a second output signal proportional to the difference of the filtered sum and filtered difference signals, such that in the case that the pair of audio input signals includes a center panned signal component, the listener listening to the first and second output signals through headphones is provided with the sensation that the center panned signal component emanates from the virtual sound source at the center location.

26. An apparatus as recited in claim 25, wherein response for the sum filter that approximates twice the center HRTF is obtained as the sum of equalized versions of the near ear HRTF and the far ear HRTF, respectively obtained by filtering the near ear HRTF and the far ear HRTF, respectively, by an equalizing filter, and wherein the difference filter is a filter that has a response substantially equal to the difference between the equalized versions of the near ear HRTF and the far ear HRTF.

27. An apparatus as recited in claim 26, wherein the equalizing filter is an inverse filter for a filter proportional to the sum of the near ear HRTF and the far ear HRTF.

28. An apparatus as recited in claim 27, wherein the equalizing filter response is determined by inverting in the frequency domain a filter response proportional to the sum of the near ear HRTF and the far ear HRTF.

29. An apparatus as recited in claim 27, wherein the equalizing filter response is determined by an adaptive filter method to invert a filter response proportional to the sum of the near ear HRTF and the far ear HRTF.

30. An apparatus as recited in claim 25, wherein the sum filter has a response substantially equal to twice a desired center HRTF.

31. An apparatus as recited in claim 25, wherein the audio input signals include a left input and a right input, wherein the pair of virtual speakers are at a left virtual speaker location and a right virtual speaker location symmetric about the listener, and wherein the listener and listening are symmetric such that near HRTF is the left virtual speaker to left ear HRTF and the right virtual speaker to right ear HRTF, and such that far HRTF is the left virtual speaker to right ear HRTF and the right virtual speaker to left ear HRTF.

32. An apparatus as recited in claim 25, wherein the audio input signals include a left input and a right input, wherein the pair of virtual speakers are at a left virtual speaker location and a right virtual speaker location, and wherein the near HRTF is proportional to the average of the left virtual speaker to left ear HRTF and the right virtual speaker to right ear HRTF, and wherein the far HRTF is proportional to the average of the left virtual speaker to right ear HRTF and the right virtual speaker to left ear HRTF.

33. An apparatus as recited in claim 25, wherein the audio input signals include a left input and a right input, wherein the pair of virtual speakers are at a left front virtual speaker location and a right front virtual speaker location to the front of the listener.

34. An apparatus as recited in claim 33, wherein the left front and right front virtual speaker locations are at azimuth angles of magnitude between 45 and 90 degrees to the listener.

35. An apparatus as recited in claim 25, wherein the audio input signals include a left input and a right input, wherein the pair of virtual speakers are at a left rear virtual speaker location and a right rear virtual speaker location to the rear of the listener.

36. An apparatus as recited in claim 25, wherein the audio input signals are a subset of a set of more than two input signals for surround sound playback, and wherein the apparatus includes an element configured accept and process the set of more than two input signals for listening through headphones, the processing by the element including creating virtual speaker locations for each of the input signals.

37. A method comprising:

filtering a pair of audio input signals by a process that produces a pair of output signals corresponding to the results of:

applying a head related transfer function ("HRTF") filter pair to filter the pair of audio input signals; and adding the HRTF filtered signals, wherein the HRTF filter pair are such that a listener listening to the pair of output signals through headphones experiences sounds from a pair of desired virtual speaker locations, wherein the filtering is such that, in the case that the pair of audio input signals includes a center panned signal component, the listener listening to the pair of output signals through headphones is provided with the sensation that the center panned signal component emanates from a virtual sound source at a center location between the virtual speaker locations, wherein the audio input signals include a left input and a right input, and wherein the pair of virtual speakers either are at a left front virtual speaker location and a right front virtual speaker location to the front of the listener, OR at a left rear virtual speaker location and a right rear virtual speaker location to the rear of the listener, wherein the HRTF filter pair includes a near ear HRTF and a far ear HRTF for the listener listening to a pair of virtual speakers at the desired virtual speaker locations, and wherein applying the HRTF filter pair to the pair of audio input signals is equivalent to:

shuffling the input signals to create a first signal ("sum signal") proportional to the sum of the input signals and a second signal ("difference signal") proportional to the difference of the input signals;

filtering the sum signal through a filter that approximates twice a center HRTF for a listener listening to a virtual sound source at a center location;

filtering the difference signal through a filter that approximates the difference between the near ear HRTF and the far ear HRTF; and unshuffling the filtered sum signal and the filtered difference signal to create a first output signal proportional to the sum of the filtered sum and filtered difference signals and a second output signal proportional to the difference of the filtered sum and filtered difference signals.

38. A method as recited in claim 37, wherein the filtering of the pair of audio input signals includes:

shuffling the input signals to create a first signal ("sum signal") proportional to the sum of the input signals and a second signal ("difference signal") proportional to the difference of the input signals;

filtering the sum signal through a filter that approximates twice a center HRTF for a listener listening to a virtual sound source at a center location;

filtering the difference signal through a filter that approximates the difference between the near ear HRTF and the far ear HRTF; and unshuffling the filtered sum signal and the filtered difference signal to create a first output signal proportional to the sum of the filtered sum and filtered difference signals and a second output signal proportional to the difference of the filtered sum and filtered difference signals.

39. A method as recited in claim 37, wherein the filter that approximates twice the center HRTF is a filter that has a response substantially equal to twice a desired center HRTF.

40. A method as recited in claim 37, wherein the HRTF filter pair consists of an equalized near ear HRTF and an equalized far ear HRTF, the equalized near ear HRTF and the equalized far ear HRTF obtained by respectively equalizing a near ear HRTF and a far ear HRTF for the listener listening to a pair of virtual speakers at the desired virtual speaker locations, the equalizing using an equalizing filter configured such that the average of the equalized near ear HRTF and equalized far ear HRTF is a desired center HRTF for the listener listening to a virtual sound source at a center location.

41. A method as recited in claim 40, wherein the equalizing filter is an inverse filter for a filter proportional to the average of the near ear HRTF and the far ear HRTF.

42. A method as recited in claim 37, wherein the filtering the pair of audio input signals is such that that the sum of the pair of audio input signals is filtered by a filter response substantially equal to a desired center HRTF.

43. A method as recited in claim 37, wherein the audio input signals include a left input and a right input, wherein the pair of virtual speakers are at a left virtual speaker location and a right virtual speaker location symmetric about the listener, and wherein the listener and listening are symmetric such that near HRTF is the left virtual speaker to left ear HRTF and the right virtual speaker to right ear HRTF, and such that far HRTF is the left virtual speaker to right ear HRTF and the right virtual speaker to left ear HRTF.

44. A method as recited in claim 37, wherein the audio input signals include a left input and a right input, wherein the pair of virtual speakers are at a left virtual speaker location and a right virtual speaker location, and wherein the near HRTF is proportional to the average of the left virtual speaker to left ear HRTF and the right virtual speaker to right ear HRTF, and wherein the far HRTF is proportional to the average of the left virtual speaker to right ear HRTF and the right virtual speaker to left ear HRTF.

45. A method as recited in claim 37, wherein the audio input signals include a left input and a right input, wherein the pair of virtual speakers are at a left front virtual speaker location and a right front virtual speaker location to the front of the listener.

46. A method as recited in claim 45, wherein the left front and right front virtual speaker locations are at azimuth angles of magnitude between 45 and 90 degrees to the listener.

47. A method as recited in claim 37, wherein the audio input signals include a left input and a right input, wherein the pair of virtual speakers are at a left rear virtual speaker location and a right rear virtual speaker location to the rear of the listener.

48. A method as recited in claim 37, wherein the audio input signals are a subset of a set of more than two input signals for surround sound playback, and wherein the method includes processing the set of more than two input signals for listening through headphones, including creating virtual speaker locations for each of the input signals.

49. A method comprising:

filtering a pair of audio input signals for audio reproduction, the filtering by a process that produces a pair of output signals corresponding to the results of:

filtering each of the input signals with a head related transfer function ("H RTF") filter pair;

adding the HRTF filtered signals; and cross-talk cancelling the added HRTF filtered signals, wherein the cross-talk cancelling is for a listener listening to the pair of output signals through speakers located at a first set of speaker locations, wherein the HRTF filter pair are such that a listener listening to the pair of output signals experiences sounds from a pair of virtual speakers at desired virtual speaker locations, wherein the filtering is such that, in the case that the pair of audio input signals includes a center panned signal component, a listener listening to the pair of output signals through the pair of speakers at the first set of speaker locations is provided with the sensation that the center panned signal component emanates from a virtual sound source at a center location between the desired virtual speaker locations, wherein the HRTF filter pair consists of a near ear HRTF and a far ear HRTF for the listener listening to a pair of virtual sneakers at the desired virtual sneaker locations, and wherein the filtering of the pair of audio input signals is equivalent to:

shuffling the input signals to create a first signal ("sum signal") proportional to the sum of the input signals and a second signal ("difference signal") proportional to the difference of the input signals;

filtering the sum signal through a filter that approximates twice a center HRTF for a listener listening to a virtual sound source at a center location:

filtering the difference signal through a filter that approximates the difference between the near ear HRTF and the far ear HRTF; and unshuffling the filtered sum signal and the filtered difference signal to create a first output signal proportional to the sum of the filtered sum and filtered difference signals and a second output signal proportional to the difference of the filtered sum and filtered difference signals.

50. A method as recited in claim 49, wherein the filtering of the pair of audio input signals includes:

shuffling the input signals to create a first signal ("sum signal") proportional to the sum of the input signals and a second signal ("difference signal") proportional to the difference of the input signals;

filtering the sum signal through a filter that approximates twice a center HRTF for a listener listening to a virtual sound source at a center location;

filtering the difference signal through a filter that approximates the difference between the near ear HRTF and the far ear HRTF; and unshuffling the filtered sum signal and the filtered difference signal to create a first output signal proportional to the sum of the filtered sum and filtered difference signals and a second output signal proportional to the difference of the filtered sum and filtered difference signals.

51. A method as recited in claim 49, wherein the filter that approximates twice the center HRTF is a filter that has a response substantially equal to twice a desired center HRTF.

52. A method as recited in claim 49, wherein the HRTF filter pair consists of an equalized near ear HRTF and an equalized far ear HRTF, the equalized near ear HRTF and the equalized far ear HRTF obtained by respectively equalizing a near ear HRTF and a far ear HRTF for the listener listening to a pair of virtual speakers at the desired virtual speaker locations, the equalizing using an equalizing filter configured such that the average of the equalized near ear HRTF and equalized far ear HRTF is a desired center HRTF for the listener listening to a virtual sound source at a center location.

53. A method as recited in claim 52, wherein the equalizing filter is an inverse filter for a filter proportional to the average of the near ear HRTF and the far ear HRTF.

54. A method as recited in claim 49, wherein the filtering of the pair of audio input signals is such that that the sum of the pair of audio input signals is filtered by a filter response substantially equal to twice a desired center HRTF.

55. A method as recited in claim 49, wherein the audio input signals include a left input and a right input, wherein the pair of virtual speakers are at a left virtual speaker location and a right virtual speaker location symmetric about the listener, and wherein the listener and listening are symmetric such that near HRTF is the left virtual speaker to left ear HRTF and the right virtual speaker to right ear HRTF, and such that far HRTF is the left virtual speaker to right ear HRTF and the right virtual speaker to left ear HRTF.

56. A method as recited in claim 49, wherein the audio input signals include a left input and a right input, wherein the pair of virtual speakers are at a left virtual speaker location and a right virtual speaker location, and wherein the near HRTF is proportional to the average of the left virtual speaker to left ear HRTF and the right virtual speaker to right ear HRTF, and wherein the far HRTF is proportional to the average of the left virtual speaker to right ear HRTF and the right virtual speaker to left ear HRTF.

57. A method as recited in claim 49, wherein the audio input signals include a left input and a right input, wherein the pair of virtual speakers are at a left front virtual speaker location and a right front virtual speaker location to the front of the listener.

58. A method as recited in claim 57, wherein the left front and right front virtual speaker locations are at azimuth angles of magnitude between 45 and 90 degrees to the listener.

59. A method as recited in claim 49, wherein the audio input signals include a left input and a right input, wherein the pair of virtual speakers are at a left rear virtual speaker location and a right rear virtual speaker location to the rear of the listener.

60. A method as recited in claim 49, wherein the audio input signals are a subset of a set of more than two input signals for surround sound playback, and wherein the method includes processing the set of more than two input signals for listening through headphones, including creating virtual speaker locations for each of the input signals.

61. A method comprising:

accepting a pair of audio input signals for audio reproduction;

shuffling the input signals to create a first signal ("sum signal") proportional to the sum of the input signals and a second signal ("difference signal") proportional to the difference of the input signals;

filtering the sum signal through a filter that approximates the sum of an equalized version of a near ear head related transfer function ("HRTF") and an equalized version of a far ear HRTF, the near ear and far ear HRTFs being for a listener listening to a pair of virtual speakers at corresponding virtual speaker locations, the equalized versions obtained using an equalization filter designed such that the average of the equalized near ear HRTF and equalized far ear HRTF approximates a center HRTF for a listener listening to a virtual sound source at a center location between the virtual speaker locations;

filtering the difference signal through a filter that approximated the difference between the equalized version of the near ear HRTF and the equalized version of the far ear HRTF for the listener listening to the pair of virtual speakers; and unshuffling the filtered sum signal and the filtered difference signal to create a first output signal proportional to the sum of the filtered sum and filtered difference signals and a second output signal proportional to the difference of the filtered sum and filtered difference signals, such that in the case that the pair of audio input signals includes a center panned Signal component, the listener listening to the first and second output signals through headphones is provided with the sensation that the center panned signal component emanates from the virtual sound source at the center location.

* * * * *

UNITED STATES PATENT AND TRADEMARK OFFICE

CERTIFICATE OF CORRECTION

PATENT NO. : 7,634,092 B2
APPLICATION NO. : 10/965130
DATED : December 15, 2009
INVENTOR(S) : David S. McGrath It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1462 days.

Signed and Sealed this

Ninth Day of November, 2010

David J. Kappos

David J. Kappos
*Director of the United States Patent and Trademark Office*